US008931238B2

(12) United States Patent
Lee

(10) Patent No.: US 8,931,238 B2
(45) Date of Patent: Jan. 13, 2015

(54) CERAMIC DOORS AND BOARDS AND APPLICATIONS THEREOF

(76) Inventor: Hoong Thye Eldon Lee, Singapore (SG)

( * ) Notice: Subject to any disclaimer, the term of this patent is extended or adjusted under 35 U.S.C. 154(b) by 869 days.

(21) Appl. No.: 12/093,318

(22) PCT Filed: Nov. 10, 2006

(86) PCT No.: PCT/SG2006/000344

§ 371 (c)(1),
(2), (4) Date: Nov. 17, 2008

(87) PCT Pub. No.: WO2007/055662

PCT Pub. Date: May 18, 2007

(65) Prior Publication Data

US 2009/0315437 A1 Dec. 24, 2009

(30) Foreign Application Priority Data

Nov. 10, 2005 (SG) ..... 200507151-9

(51) Int. Cl.
*E04C 2/32* (2006.01)
*E04C 2/38* (2006.01)
(Continued)

(52) U.S. Cl.
CPC . *E06B 3/70* (2013.01); *E06B 5/006* (2013.01); *E06B 5/16* (2013.01); *E06B 2003/7049* (2013.01)
USPC ..... 52/783.11; 52/784.12; 52/798.1; 52/800.1

(58) Field of Classification Search
USPC ..... 52/800.1–800.13, 801.1, 801.11, 784.1, 52/784.11, 784.15, 793.1, 783.1–783.15, 52/798.1, 797.1, 223.6, 601–603, 422
See application file for complete search history.

(56) References Cited

U.S. PATENT DOCUMENTS 526,732 A * 10/1894 Norcross ..... 52/408
1,317,519 A * 9/1919 Madison ..... 52/454
(Continued)

FOREIGN PATENT DOCUMENTS

DE 10349952 A1 * 6/2005
EP 1088946 A2 * 4/2001
(Continued)

OTHER PUBLICATIONS

WIPO, International Search Report for International Application No. PCT/SG2006/000344.

*Primary Examiner* — Elizabeth A Plummer
(74) *Attorney, Agent, or Firm* — Intellectual Property Law Group LLP

(57) ABSTRACT

A ceramic board (1), of at least cement and gypsum, preferably in the proportions 1:10, and can include additional filler material in the composition. The board is used for various applications including as a door panel (31) or cabinet door (81). The board (21) can have channels, grooves, honeycomb, corrugations, or protrusions (22) extending along one or both faces which help to lighten the board whilst retaining rigidity, and which can have filler material (103) provided therein. The board (31) can have mounting points (35) for cabinet hinges or a lock, and can have internal strengthening members (142*a,b,c*) within the material of the board. The board or door can have an edge protector, which can be internal (153) or external (112). An end of the board can form a recess (184) for cables, pipes etc, which can be formed by internal strengtheners protruding from the end of the ceramic material (FIGS. 18*a*, 18*b*). The board can have an internal frame or skeleton embedded within the ceramic material.

47 Claims, 21 Drawing Sheets

(51) Int. Cl.

| | |
|---|---|
| ***E06B 3/70*** | (2006.01) |
| ***E06B 5/00*** | (2006.01) |
| *E06B 5/16* | (2006.01) |

(56) References Cited

U.S. PATENT DOCUMENTS

| | | | | | |
|---|---|---|---|---|---|
| 1,963,410 | A | * | 6/1934 | Kartowicz | 52/481.2 |
| 2,607,087 | A | * | 8/1952 | Triller | 312/326 |
| 2,849,758 | A | * | 9/1958 | Plumley et al. | 52/309.15 |
| 3,260,027 | A | * | 7/1966 | Page et al. | 52/602 |
| 3,269,484 | A | * | 8/1966 | Lighter | 181/290 |
| 3,412,513 | A | * | 11/1968 | Gosele | 52/144 |
| 3,591,247 | A | * | 7/1971 | Berry et al. | 312/304 |
| 3,676,279 | A | * | 7/1972 | Beaver | 428/73 |
| 4,720,951 | A | * | 1/1988 | Thorn et al. | 52/208 |
| 4,811,538 | A | * | 3/1989 | Lehnert et al. | 52/455 |
| 4,901,493 | A | * | 2/1990 | Thorn | 52/309.9 |
| 5,171,366 | A | * | 12/1992 | Richards et al. | 106/772 |
| 6,773,791 | B1 | * | 8/2004 | Ruggie et al. | 428/156 |
| 6,872,434 | B2 | * | 3/2005 | Zen | 428/36.9 |
| 7,775,013 | B2 | * | 8/2010 | Bartlett et al. | 52/800.11 |
| 2003/0019177 | A1 | * | 1/2003 | Kwon | 52/426 |
| 2003/0178250 | A1 | * | 9/2003 | Putt et al. | 181/290 |
| 2005/0076593 | A1 | * | 4/2005 | Bartlett et al. | 52/455 |

FOREIGN PATENT DOCUMENTS

| | | | | |
|---|---|---|---|---|
| FR | 2680382 | A1 | * | 2/1993 |
| GB | 2266912 | A | * | 11/1993 |
| JP | 62253866 | A | * | 11/1987 |

* cited by examiner

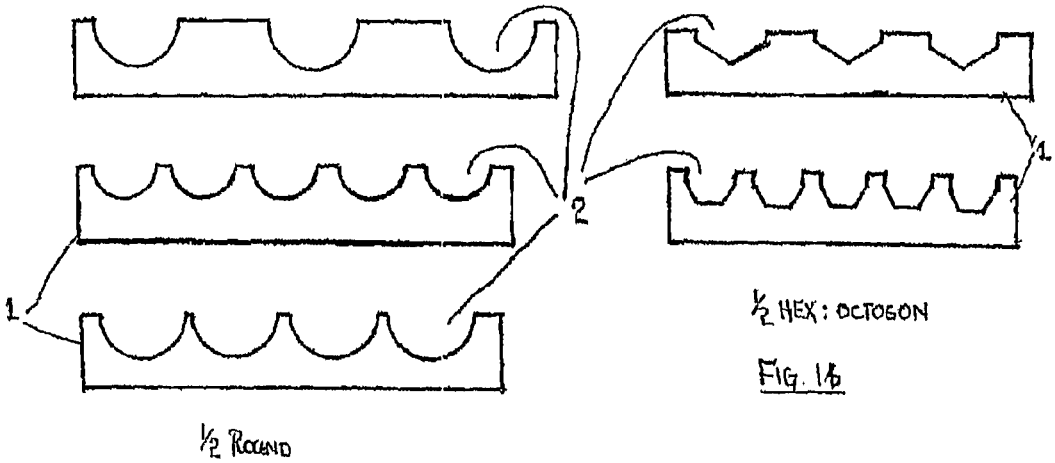
FIG. 1b
½ ROUND
FIG. 1A
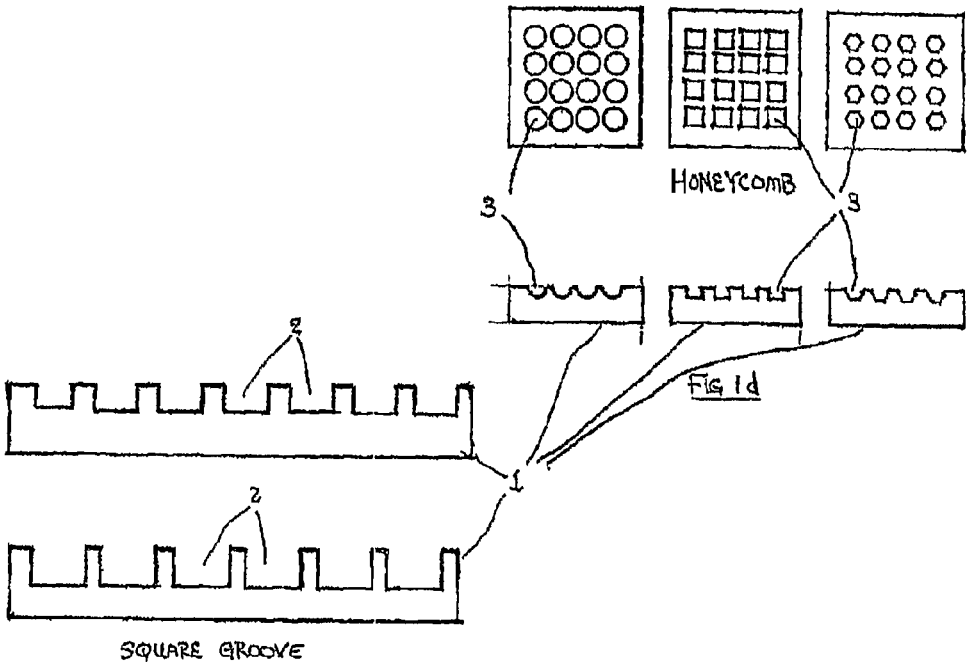
FIG 1d
FIG 1c

TYPES OF FRAMEWORK/SKELTON

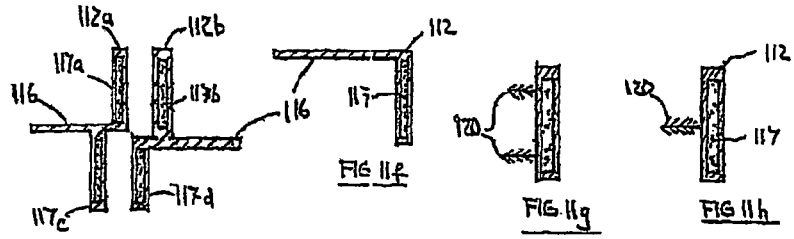
FIG 11e
FIG 11g
FIG 11h
FIG 11c
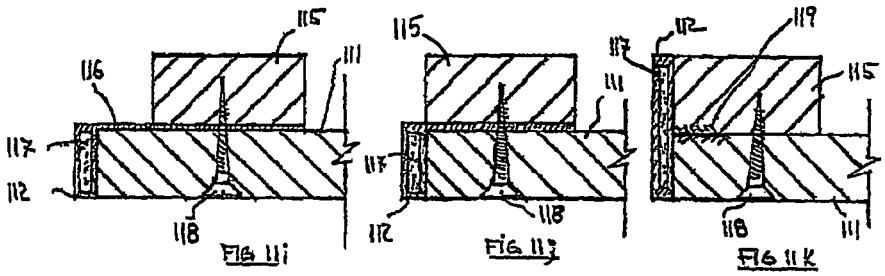
FIG 11i
FIG 11j
FIG 11k
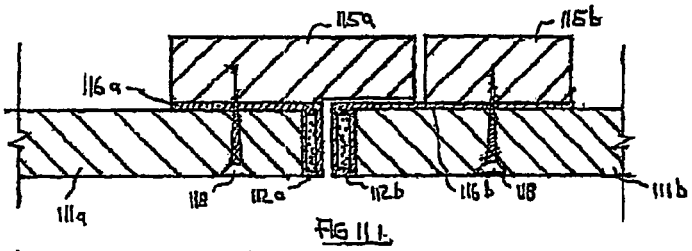
FIG 11l
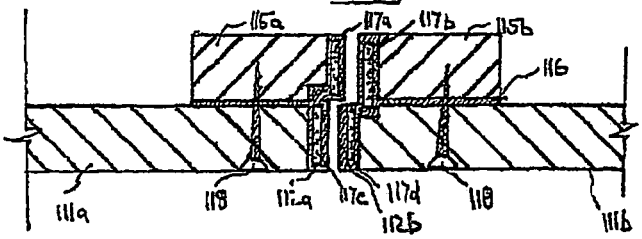
FIG 11m 171
173a 172
171
173b 172b
171
172a
173c

174

CERAMIC DOORS AND BOARDS AND APPLICATIONS THEREOF

TECHNICAL FIELD

The present invention relates to ceramic door and door boards and applications thereof. In particular the present invention relates to applications of ceramic door and door boards in the building and construction of industrial, commercial and residential doors, door and wall boards and cupboard doors, and to components therefor.

BACKGROUND

Traditionally doors are made of metal (typically steel), solid wood (solid core) or wooden framing and boards (hollow core). Typically modern doors are constructed relatively cheaply by placing a wooden or laminate cladding over a structured or 'honeycomb' core.

Solid core doors require a large amount of quality timber, and given the increasing pressures to reduce consumption of quality timber trees are becoming increasingly expensive and environmentally unacceptable.

Metal doors, especially steel doors, although strong and fire resistant, are relatively heavy, expensive to produce compared to wooden doors, and cannot be adapted on site to suit a particular size of frame or application.

Furthermore, hollow or structured core timber doors do not intrinsically posses the high thermal insulation required to resist or prevent the spread of fire, and must be laminated or clad with various fire resistant materials to increase inflammability, which can significantly increase production costs.

Also, sound insulation properties of wooden hollow and structured core doors are typically poor such that additional sound insulating materials can be required.

In addition, wooden hollow or structured core doors have poor water resistant properties, and will tend to delaminate, warp or swell when consistently exposed to water or humidity, such as in wet, tropical or subtropical conditions e.g. high humidity, high rainfall. Even in temperate conditions, if exposed to rain or humidity, such doors have a short lifespan.

Low cost doors are also prone to change in shape and dimensions, typically due to warpage or shrinkage.

Metal doors are prone to corrosion when exposed to wet weather and/or high humidity for prolonged periods.

Ceramic boards per se are known in the building and construction industry. Generally the most common boards are gypsum boards, cement fibre boards, glass reinforced cement (GRC) or glass reinforced gypsum (GRG), and calcium silicate boards. Such boards are typically manufactured between 3 mm and 25 mm thick, and are basically flat sheets with density ranging from 800-1800 $kgm^{-3}$ with the exception of GRC which has a bulk density of 2200-2500 $kgm^{-3}$.

Cement is a fine calcinated powder typically containing silica, alumina, calcium oxide (lime) and often iron oxide(s) and magnesia. Gypsum is finely divided calcium sulphate usable as a calcinated powder.

Traditionally, wall partitions use purely gypsum boards for general use. These are relatively low in cost to manufacture and install but are not waterproof and have low security being soft.

However, should waterproofing be required, cement or GRC fibreboards are used. Cement fibreboards cannot be fire rated due to inherent shrinkage of cement and high content of organic cellulose fibre which is removed from the cement fibreboard at temperatures above 300-400° C. Such boards typically undergo cracking and structural failure at high temperature.

Similarly, GRC boards suffer from cement shrinkage at high temperature regardless of the glass fibre content.

GRG boards typically include gypsum, fillers and glass fibres. These boards can be fire rated but are not waterproof due to the high gypsum content and are relatively soft. They are therefore generally used for internal applications, such as plaster ceiling boards where they are not subject to dampness or pressure.

Subsequently, calcium silicate boards have been developed. However, these require increased investment in manufacturing plant and machinery, such as autoclaves and steel drum rollers etc, and are therefore more expensive to manufacture than other boards.

Previously, lightweight doors and door cores using cement and/or gypsum have been proposed. For example, GB 2250282 and GB 2266912 by the same inventor of the present invention disclose applications of a door or core board for a door made of lightweight set and hardened material based on cement and/or gypsum. Lightweight characteristics are achieved by having large voids in the board and/or addition of lightweight particulate or fibrous material. However, the resulting board has a resulting typical bulk density of only 400-700 $kgm^3$. Such a lightweight material tends to be brittle and crumbly, and subject to chipping, cracking particularly at the edges thereof, thereby requiring edge support in the form of wooden or metal framing to add strength and reduce the risk of damage or failure of the door board.

Further, cabinet hinges are specially made for light, thin timber based doors which are usually particleboard, chipboard, MDF, HDF, blockboard of thickness of 10 mm to 30 mm. Their main applications have been kitchen cabinets, office cabinets, wardrobe, furniture etc., where sizes are 900/1200 high by 600/800 wide or 800/900 wide by 2100 height for full size wardrobe doors.

Such hinges are suitable for timber based doors because timber density is 400-800 kg/m3 (fairly light); but more importantly timber is an excellent medium for holding fast wood screws.

For certain designs, the cabinet hinges have been used to mount glass. The only two practical ways commonly adopted is to either use an outer timber board surrounding the glass and mount the cabinet hinges in the timber based board like usual cabinet doors, or to custom make metal 'patch fittings'—similar to bathroom shower doors—where the glass board is sandwiched between 2 metal 'patch fittings—where cabinet hinges are required to be used. The out facing 'patch fittings' is highly finished and the internal one is with custom recesses, holes to mount the cabinet hinge.

To date, there has been no requirement to use ceramic boards to mount cabinet hinges mainly because 1. these boards are usually more costly than timber based boards,
2. gypsum cement fibre, calcium silicate boards are heavier: 800-1600 $kg/m^3$, however, weight is a serious disadvantage when using cabinet hinges,
3. workability of the ceramic boards is more difficult then timber based boards—e.g. powdery face makes it hard to paint/veneer, delamination, poor adhesion, edges usually hard to finish off as most boards have jagged edges when sawn due to its brittleness/hardness.
4. cannot hold screws—unlike timber based boards, ceramic boards cannot be held secure solely on the screw threads, but require to be sandwiched between the countersunk screw head and steel studs/timber joints. All ceramic boards made to date are for fixed non-moving uses like walls partitions and ceilings.

Cabinet hinges need to be recessed into a board and require the board to be able to hold screw threads. Most hinges require 8-12 mm recess. As such, the board must be thicker than 8-12 mm, and able to hold screw in its remaining thickness.

Based on current existing boards, this would require 16-30 mm thick boards. As the lightest boards come in densities 800-1600 kg/m$^3$—double that of timber based boards, the weight would be double.

In normal furniture and cabinets, a 2-3 mm thick PVC edge strip is typically used to protect the edges of the doors. Door thickness are typically 12-16 mm which allows enough width to glue on the PVC strip or to allow a groove to be routed into the 12-16 mm wide door edge. The groove receives a projection moulded onto the back of the PVC strip to provide better attachment of the strip.

The present invention is concerned with ceramic door, door boards or wall boards constructed from compositions containing at least gypsum, cement and preferably additional materials, in selected proportions which result in a product which alleviates the aforementioned detrimental structural and/or application characteristics of the aforementioned boards.

Using normal known panels it is difficult to finish off and/or protect the edges. This is because most known boards are laminated to give strength and rigidity e.g. plastic laminate sandwiching chipboard, and to receive face fixings. When a 18-30 mm board is used as a partition, door or wallboard, and the edge of the board stops an opening where there is traffic or movement, a capping or protector is required for the edges to prevent chipping, fraying and damage. Currently a thin aluminium channel would be capped over the edge of the board and screwed form the face or back. This provides an unsightly fixing with exposed fixings and which may not be retained very well in the panel.

SUMMARY OF THE INVENTION

With the aforementioned in mind, according to a first form of the present invention there is provided a ceramic board having a material composition including at least one of calcium silicate, gypsum, cement or magnesium oxide, said board having two substantially parallel opposed faces each having a length and width, at least one of said faces having fins, webs, grooves, ridges, channels, corrugations or a regular or irregular arrangement of indentations or protrusions.

Thus, advantageously, the board exhibits reduced overall weight compared to known boards whilst also incorporating integral stiffening members.

Preferably the fins, ribs, webs, grooves, ridges, channels, corrugations or a regular or irregular arrangement of indentations or protrusions extend over the entire length and width of said at least one face of the board.

Preferably the fins, ribs, webs, grooves, ridges, channels or corrugations extend discontinuously on at least one of the at least one face.

Preferably the board may include a supporting framework mounted to one of the faces.

More preferably the board may have a material composition including at least one of calcium silicate, gypsum, cement or magnesium oxide, said board having a periphery, and first and second substantially parallel opposed faces, said board including a supporting framework mounted to one of the faces.

Preferably at least one of the faces may have grooves, ridges, channels, corrugations or a regular or irregular arrangement of indentations or protrusions.

Preferably the supporting framework includes timber, metal, plastic, ceramic board, or any combination thereof.

Preferably the supporting framework may be attached to the first face by fasteners extending through the material of the board from the second face thereof.

Preferably the supporting framework may extend around a portion of the periphery of the face of the board.

Preferably the supporting framework may be inset from the periphery of the face.

Preferably the board may be a door arranged to be mounted to via hinges to a door frame, cabinet or the like. Preferably the door or framework may include an intumescent seal for creating a seal between said door and the door frame or cabinet.

A further form of the present invention provides a ceramic board having a material composition including at least one of calcium silicate, gypsum, cement or magnesium oxide, said board having two substantially parallel opposed faces each having a length and width, at least one of said faces having fins, webs, grooves, ridges, channels, corrugations or a regular or irregular arrangement of indentations or protrusions.

A further aspect of the present invention provides a ceramic board having a material composition including at least one of calcium silicate, gypsum, cement or magnesium oxide, said board having two substantially parallel opposed faces each having a length and a width, a first one of said faces being generally planar and a second one of said faces having integral fins, webs, grooves, ridges, channels corrugations or an integral regular or irregular arrangement of indentations or protrusions.

Thus, advantageously, a relatively lightweight, fire resistant board is provided which is suitable to be decorative on one side yet provided with lightening, strengthening portions on the other side, which portions may also be used to assist in receiving support means and/or hinges for mounting the board as a door.

Preferably the fins, webs, grooves, ridges, channels, corrugations or a regular or irregular arrangement of indentations or protrusions may extend over a substantial proportion, more preferably substantially the entire length and width, of said second face of the board.

Preferably the fins, webs, grooves, ridges, channels or corrugations may extend discontinuously with respect to the second face.

Preferably the first face of the ceramic board may be substantially flat, and either smooth or lightly textured, which advantageously provides a suitable surface for decoration or mounting other materials, such as decorative and/or protective laminates or sheeting thereto. Alternatively, the first face may include an integral decorative pattern thereon, thereby not requiring external application of decoration unless optional painting or protective coating is preferred.

A further aspect of the present invention provides a door assembly having a door panel including at least one ceramic board and at least two cabinet hinges for hingedly mounting the door panel to operate as a cabinet door.

Advantageously, the cabinet hinge is concealed from the outside when the door is shut, thus providing not only a pleasing visual effect of continues cabinets and doors, but also a protection from fire, heat and moisture when the door is shut. This is particularly advantageous in high fire risk areas, such as equipment cabinets eg electrical cabinets, or in high water/humidity conditions such as in the tropics/sub tropics or high rainfall. The ceramic door provides heat and fire resistance to the cabinet and hinge therebehind, whilst the concealed cabinet hinge provides concealed support to the door. In addition, the hinge side edge of the ceramic board door can be allowed to overlap the front side edge of the cabinet, thereby providing additional fire, heat and moisture protection to the cabinet, thus reducing the risk of additional fire from the cabinet burning. The ceramic door provides additional fire protection to the home and business by reducing the amount of likely overall fire or water damage to fixtures and fittings behind the door, whilst also protecting the contents of the space behind the door. Thus the combination of ceramic board and cabinet hinge provides a synergistic effect, one working with the other to provide hitherto unconsidered benefits.

A further form of the present invention provides a door comprising at least a first and a second board, at least one of the boards being as mentioned above, said boards being connected together in a face to face relationship such that the fins, webs, grooves, ridges, channels, corrugations or a regular or irregular arrangement of indentations or protrusions of the first board are connected to a face of the second board.

Preferably the at least a first and second board are connected in a back to back relationship with the fins, webs, grooves, ridges, channels, corrugations or a regular or irregular arrangement of indentations or protrusions of the first board facing the fins, webs, grooves, ridges, channels, corrugations or a regular or irregular arrangement of indentations or protrusions of the second board. Preferably the fins or webs of the first board of the door may be connected to the fins or webs of the second board by screw or nail fastening, clamping, adhesive, or any combination thereof.

The present invention in one or more forms thereof further allows for cabinet hinges to be mounted to ceramic boards to operate as a cabinet door. This may be achieved in one or more forms of the present invention by providing at least one ceramic board mounted to a supporting frame or blocks of material, wherein said blocks or frame is/are suitable for retaining hinges and/or a lock.

The thinnest board may be used—say 3-6 mm, so that the weight is kept to a minimum.

To cater for the cabinet hinge required recess extra material may be added to the back (inside facing) of the board only where the hinges are located. For non-fire rated or 30 minutes fire rating applications, timber or timber based materials may be used.

The size of the hinge provision may be say, 75 mm high by 50 mm wide by 15 mm thick. This would be adequate for recessing and attaching screws into.

As most ceramic boards cannot hold screw threads, the hinge provisions may be glued and screwed in place on the board.

Preferably, the fasteners eg screws may be face fixed (front) with fastening means eg threads penetrating the board to secure in the hinge provision thus sandwiching the board between the counter sunk screw heads and the hinge provisions. Care may be taken to ensure that the screws holding the board to the hinge provisions do not fall in the same place where the screws to secure the cabinet hinge go into later, (eg see FIG. 3). In the case of face fixed screws, these may be countersunk to install until flush with the face. Exposed fastener heads on the face side of the board may be disguised by putty and sanded for painting so that the screws are not visible. A similar approach would apply for the lock-lock provision.

For commercial jobs where standard locks are used, it would not be possible to install a mortice lock body of say 10-15 mm into a 3-30 mm board. In this case, the thickness of the lock provision is important, as the whole mortice lock case will be surface mounted to the lock provision. (visible on the inside). Again, care may be taken to ensure that any front penetrating screws, and the screws holding the lock do not fall in the same place.

Furthermore, to use key cylinders, the lock provision may be of suitable thickness to fit in the cylinder so that the lock can be installed as a normal cylinder, i.e., usual mortice locks are installed in the middle of a normal 35-45 mm door, to get the same position, the lock provision thickness would be 15-25 mm to give the same effect so that the cylinder does not protrude too much out of the board face or get recessed in too deep.

Depending on the test standard applied, these arrangements may be coated with intumescent paint. This would help prevent the timber based materials from igniting—a cause of integrity failure, and burning away too soon in a test so as to not support the board at all. Alternatively or in addition to other insulating materials, rockwool, ceramic fibre, glass wool can be used on the back of the cabinet door for insulation.

When purpose made boards are considered, for door and cabinet door applications, the stiffeners may be placed at suitable intervals to suit the specific usage. The height and width of the stiffeners is such that it is adequate to attach stiles (vertical members) by both mechanical and glue methods. The stiffeners may be more closely spaced at the edges of the board to allow for cutting to suit site variations, or further spaced out in the middle of the board to reduce weight and production costs. When added stability is needed, the stiffeners may be increased in height such that they overlap and joined.

For single ceramic board cabinet doors, with the smooth face facing outside, additional provisions may be needed to attach cabinet hinges and locks. Ideally, small metal reinforcements may be located in the board to take screws later.

Furthermore, for larger cabinets—1 m W×2 m H, the board may weight 20-40 kg, it would be difficult to install hinges that require substantial removal of material. In this embodiment, the stiffeners for the hinges may be only one and located at one extreme edge of the board. The rest may be smaller stiffeners. To suit the required size on site, cutting would be done from the other edge distal from the single stiffener (hinge) edge.

Alternatively, special metal/plastic clamps may be used to cover over several stiffeners at the hinge area to provide more secure fastening. For fire rated cabinet doors the clamps must be in metal—preferably steel. Since most cabinet hinges are made of die-cast materials, they will melt and not hold the door up. As such, restraints, such as provided into a metal hold fast (clamp), may be used on the hinge side to keep the door in place in the closed position—these are termed high temperature (metal) restraints which may be located with the metal holdfast (clamp) or located separately as shown in FIGS. 9*a-e*.

Alternatively, the skeleton can have grooves or ridges to engage the corresponding groove or ridge on the cabinet to act as a high temperature restraint.

Should the door assembly be subjected to fire and extreme heat such that alloy hinges melt and/or fail, the door may remain substantially in a closed position, held closed by preferable restraints. Thus, advantageously, the restraint(s) additionally protect the interior space and anything within in the event that the hinges fail. Alternative arrangements of the restraint(s) is/are envisaged, for example, utilising a member extending into a recess or channel on the cabinet side.

Alternatively or in addition, the restraint(s) may include a screw threaded member extending into either the door or cabinet side, with the head of the member extending into the recess or channel, thereby holding the door closed in the event of hinge failure.

To date, calcium silicate, gypsum, cement fibre boards have been used for door—but only to increase its fire rating and/or improve acoustic properties.

Again, these doors have to be face screwed to a rigid/secure skeleton and covered by plywood and/or finishing materials.

This means that ceramic board cannot be used as a finished face without coverings/decorations on it.

The reason mainly being: Most ceramic boards were made for fixed applications, partitions, ceilings, etc., and designed to be mechanically attached by screws etc. Most ceramic boards are made to take paint/wallpaper—as such their surface is usually powdery and porous and adhere to paint and wallpaper with difficulty.

This is not suitable for door faces as compared to plywood which is lighter in density, has non-powdery faces that have extremely good sound surfaces to take adhesives like PVA, UF, acrylic and most common glues. Plywood also is able to hold nails—even extremely tiny nails with small heads can be used to securely hold a plywood face to the skeleton. These tiny nails are currently used with adhesives to give a mechanical+chemical bond to plywood faced doors and is the most common method worldwide.

Since the nail heads are small, the finish of the door is very acceptable. On the other hand, if ceramic board were to be used as a door face directly, the problems to overcome are:

1. Adhesion to the skeleton—being powdery and porous, most ceramic boards were not made to be installed, depending to keep in place by adhesion only.
2. Small plywood nails—to date there is not a ceramic board that can be held securely based only on small head nails and swung open and close without coming undone sooner or later. This is because all ceramic boards are brittle, crumbly by nature and possess no ductility, malleability or tensile strength. If a headless pin were introduced into any ceramic board, it can be easily pulled out from the other side with less force than if the same pin was in similar thick ply. Furthermore, the same pin in plywood would experience a "grip" on it due to the elasticity of plywood, whereas in ceramic boards, once the pin has penetrated the board, the area surrounding the pin tends to crumble and not support any force. As such ceramic boards still require large unsightly face fixed counter-sunk screws to secure them.
3. The cut edges of most ceramic boards would chip and become jagged due to the hardness of the board, (the harder the more brittle!) Furthermore, since they lack the "elasticity" as found in hardwood, when used for long under rough conditions, the ceramic board edges would be chipped even more.

To overcome this and have a ceramic board that can be used directly as a door face, the board has advantageously been formulated to have a more sound surface with less porosity and powdery. This will make the board adhere better and not require laminate.

Another form of the present invention is provided by a hinge or lock receiver for mounting to a ceramic board, wherein the receiver includes means to attach the receiver to the board and a portion for receiving the hinge or lock.

Preferably the receiver may include opposed jaws for retainably, and optionally releasably, gripping one or more portions of the ceramic board therebetween.

Preferably the spacing between the jaws may be adjustable via an adjustment means such that the receiver can be adapted to attach to the board. The adjustment means may be in the form of a screw threaded adjuster whereby rotation in one direction increases the spacing between the jaws thus opening the jaws, and rotation in the opposite direction reduces the spacing thereby closing the jaws. Closing the jaws can be used to clamp the receiver to projections, eg in the form of fins, ribs or webs of the board.

A further form of the present invention provides an edge protector for a ceramic board. Preferably the ceramic board forms a door or is part of a door. Preferably the edge protector includes a body portion for mounting on an edge of the board or door, said portion including an intumescent seal material, which may be completely surrounded or enveloped within the portion, or may have a portion exposed to the atmosphere.

Preferably the protector includes an attachment portion which extends from the body portion. The attachment portion may be in the form of a web or tongue like projection, or ridged discrete projections or barbs or fins. The attachment portion assists mounting of the protector to the board/door, which may be by fastening the attachment portion to the board/door or hinge receiver, support or framework by direct attachment eg by fasteners, or by sandwiching the attachment portion between the board/door and hinge receiver, support or framework.

Preferably the protector may be a double protector which extends to cover an edge of the board/door and also an edge of the hinge receiver, support or framework. More preferably, the double protector is stepped to allow for overlap or underlap between the board/door and the hinge receiver, support or framework.

Preferably the protector is formed from plastics material, such as ABS, PVC, or metal, such as aluminium, or combinations thereof.

A yet further form of the present invention provides a ceramic board having integral fins, ribs and/or projections from at least one face of the board.

Preferably spaces between adjacent fins, ribs and/or webs may be filled or partly filled with lightweight filler material thereby adding stiffness, and optionally fire retardant properties, to the board without significant increase in overall weight.

The filler material may be incorporated into some or all of the spaces between fins, ribs and/or webs of a board. A filled board may be used to make or act as a door eg for a cabinet.

A form of the present invention provides a door comprising at least a first and a second board, at least one of the boards according to one of abovementioned forms of the present invention, said boards being connected together in a face to face relationship such that the fins, webs grooves, ridges, channels, corrugations or a regular or irregular arrangement of indentations or protrusions of the first board are connected to a face of the second board.

Preferably the fins, webs grooves, ridges, channels, corrugations or a regular or irregular arrangement of indentations or protrusions of the first board are connected to the fins, webs grooves, ridges, channels, corrugations or a regular or irregular arrangement of indentations or protrusions of the second board by screw or nail fastening, clamping, adhesive, or any combination thereof.

An still further form of the present invention provides a door comprising at least two ceramic boards, at least two of the boards include fins/ribs/webs projecting from a respective face thereof, the said two boards being connected together with the fins/ribs/webs of one of the two boards facing the fins/ribs/webs of the other of the two boards.

Preferably the two boards are connected together by fastening, adhering and/or bonding connector means to at least one fin/rib/web of each said board.

More preferably the two boards are connected together by the connector means being attached to the respective fin/rib/web of each board by at least one screw or nail fastener. The connector means may be a block or strip of timber, plastic or metal.

Alternatively or in addition the fins/ribs/webs of one board may be overlapped with the fins/ribs/webs of the other board and fastened, adhered and/or bonded together.

The ceramic board according to one or more forms of the present invention may include additional elongate strengthening elements to provide additional in addition to the inherent strength of the board. Such strengthening elements may be contained partially or completely within the material of the board, and may be formed with the board i.e. as integral strengthening or may be subsequently fixed to the board e.g. by adhesive bonding. The strengthening elements may be of 'L', 'T' or 'U' cross section or threaded inserts for screw mounting at least one strengthener later, or the like, and may be formed of ceramic material, plastic or metal or combinations thereof.

Preferably a portion of the cross section of the strengthening element extends into the material of the board between adjacent projections, recesses, ridges, channels, grooves, corrugations, webs or fins etc, and preferably a portion of the strengthening element extends in the plane of the board.

The ceramic board may further include additional skeleton members to add additional strength to the inherent strength of the board. These may take the form of elongate 'L', 'T' or 'U' type cross section elongate members, which may be formed of ceramic material, plastic, metal or combinations thereof.

Preferably the ceramic board or door may include fixing reinforcement means for receiving fasteners for mounting hinges. Locks, catches etc, may be in the form of a plate fixed to or embedded into the board/door. The panel may be planar, 'L' shaped. 'T' shaped, 'U' shaped or the like, and may act as an edge or corner strengthener/protector. The fixing reinforcement may include one or more flush or protruding nuts and/or threaded studs/bolts, which may be sleeved in plastic or metal. The fixing reinforcement may be a plate sandwiched between mesh panels and incorporated into the ceramic material of the board/door.

For security and to reduce the chances of cracking or breakage of the board or door panel, netting, mesh, eg of fiberglass, plastic or nylon may be used to strengthen the board.

If more strength is required, metal in the form of steel channels of 0.5-3 mm thickness can be custom provided within the material of the board and/or provided to an external surface thereof to run vertically, horizontally with respect to the board so as to allow fixing of heavy fixtures like sinks, toilet urinals, kitchen cabinet.

For external facing boards, expanded metal, wire mesh or welded mesh may be provided within and/or externally mounted/adhered.

Another form of the present invention provides a telescopic sliding door or partition system comprising at least first and second coplanar boards, the first board having a recess for receiving at least a portion of the second board, and a track for slidably mounting the boards thereon, such that, during relative motion of the respective boards the second board is received into the recess during opening movements of the door/partition and extends from the first board during closing movements of the door/partition.

Thus, the telescopic door/partition provides a convenient and practical means for separating two areas or closing off a room/space whilst requiring reduced space. With one board received in the other board when the door/partition is open, less overall thickness of the system is needed compared to known sliding door systems where the doors are arranged in side by side parallel planes when open. Furthermore, prior art systems generally require a separate track for each door, whereas the telescopic door/partition system can utilise a single coplanar track arrangement leading to a neater more efficient and cost effective system.

Preferably the second board may be completely received within the first board. More preferably the first board includes an internal stop means for preventing the second board from being received beyond a predetermined position.

Preferably the base portion of the first board includes a guide means which guides the first board over a floor guide and also guides the second board during relative motion into or out of the first board.

Preferably there is provided at least one acoustic seal internal of the first board and arranged to seal between an exterior of the second board and an interior of the first board.

Preferably the door/partition system includes a single guide track, which optionally supports at least part of the weight of the boards.

A further form of the present invention provides a ceramic board including cement and gypsum material, said board including discrete internal strengthening elements. Such internal strengthening elements help to add rigidity to the board without adding significant weight.

Preferably the board may have two substantially parallel opposed faces each having a length and width, at least one of said faces having fins, webs, grooves, ridges, channels, corrugations or a regular or irregular arrangement of indentations or protrusions. More preferably at least one of the discrete internal strengthening elements may be exposed to atmosphere at least one of the two opposed faces.

Preferably the board may have a length extending between a first and a second end, and said board includes a recess at one of said ends, said recess exposing the discrete elongate strengthening elements at said end. Thus, for example, when the board is used as a wall panel, the recess provides a channel for allowing equipment, such as pipes and cables etc to be run within the wall panel which can then be discretely hidden by a skirting panel or the like without requiring bulky boxing or box skirting to be mounted in front of the wall.

Preferably said recess may be formed at an end of one of said two opposed faces and said elements are elongate extending along and within the material of the board, and that the discrete elements are exposed at one of the faces of the board.

Preferably the discrete strengthening elements may be formed of plastic, metal, ceramic or combinations thereof, and more preferably may have a T, L or U shaped cross section, or combinations thereof.

Preferably the board may further include additional discrete strengthening members arranged at an angle with respect to the discrete internal strengthening elements.

A ceramic board according to one or more forms of the present invention may include discrete strengthening elements, which may preferably have a T, L or U shaped cross section, or may include a threaded mounting for attachment into the door or panel or mounting means, with a strengthener added later to the mounting.

Preferably the ceramic board comprises at least cement and gypsum material, and may include additional strengthening members, which may be integral to the board.

Preferably the additional strengthening members extend internal to the board.

Preferably the board has a periphery and the additional strengthening members extend adjacent the periphery, preferably within the material of the board.

A further form of the present invention provides a door or hinged or pivoted wall panel including a ceramic board according to one or more forms of the present invention.

The ceramic board or door may include a receiver for mounting an edge protector thereto, or an edge protector mounted directly to the board.

Preferably the receiver or directly fastened edge protector is fastened to the edge of the board or door by adhesive, screw fixing, nail fixing or clip fastening.

The edge protector may be a clip fit edge strip or bumper removably attached to the receiver.

The strengthening members may be discrete elongate elements extending within the material of the board.

The board may include one or more recesses at an end thereof, said recess(es) exposing a portion of said elongate elements to the exterior.

The edge protector may include an intumescent seal.

A further form of the present invention provides a sliding door system including at least one door including cement and gypsum material, wherein said at least one door has an upper end arranged to be mounted to a sliding door track.

Preferably the upper end may include panels mounted thereto and said track may include panels mounted thereto, wherein said respective panels can provide an acoustic seal.

Preferably the acoustic seal may be effected by overlapping respective projections and recesses on the respective panels.

At least one form of the present invention may provide a ceramic board having provision for mounting at least one hinge, lock or handle. For example, the ceramic board may be utilised as a cabinet door with provision for mounting hinges, lock etc.

A further form of the present invention provides a security wall board or door board including internal strengthening members formed integrally within the board/panel, which may include internal edge inserts embedded within the material of the board.

Preferably the strengtheners or inserts may be of metal, plastic fibreglass, timber or any combination thereof.

Preferably the board may have a length extending between a first and a second end, and said board includes a recess at one of said ends. Preferably the board may include internal strengthening members extending within the material of the board and said recess exposes the discrete elongate strengthening members at said end.

BRIEF DESCRIPTION OF THE DRAWINGS

FIGS. 1*a* to 1*c* show various cross sectional views of embodiments of ceramic boards according to one form of the present invention and including half round, half hexagon and square recesses through the sections.

FIG. 1*d* shows plan and cross sectional views of embodiments of the ceramic board of the present invention having arrangements of square, half round and half hexagon patterns of recesses or honeycomb effect

FIG. 7*a* shows an inset door board and FIG. 7*b* a door board mounted to overlap the cabinet side.

FIGS. 11*e* to 11*m* show alternative embodiments of a door edge protector according to a form of the present invention.

FIGS. 14*a* to 14*c* show alternative embodiments of the ceramic board according to the present invention including integral structural strengthening elements.

FIGS. 14*d* and 14*e* show alternative embodiments of a ceramic board according to the present invention including additional skeleton members

DESCRIPTION OF PREFERRED EMBODIMENTS

Figures 2A, 2B, 2C, 2D:
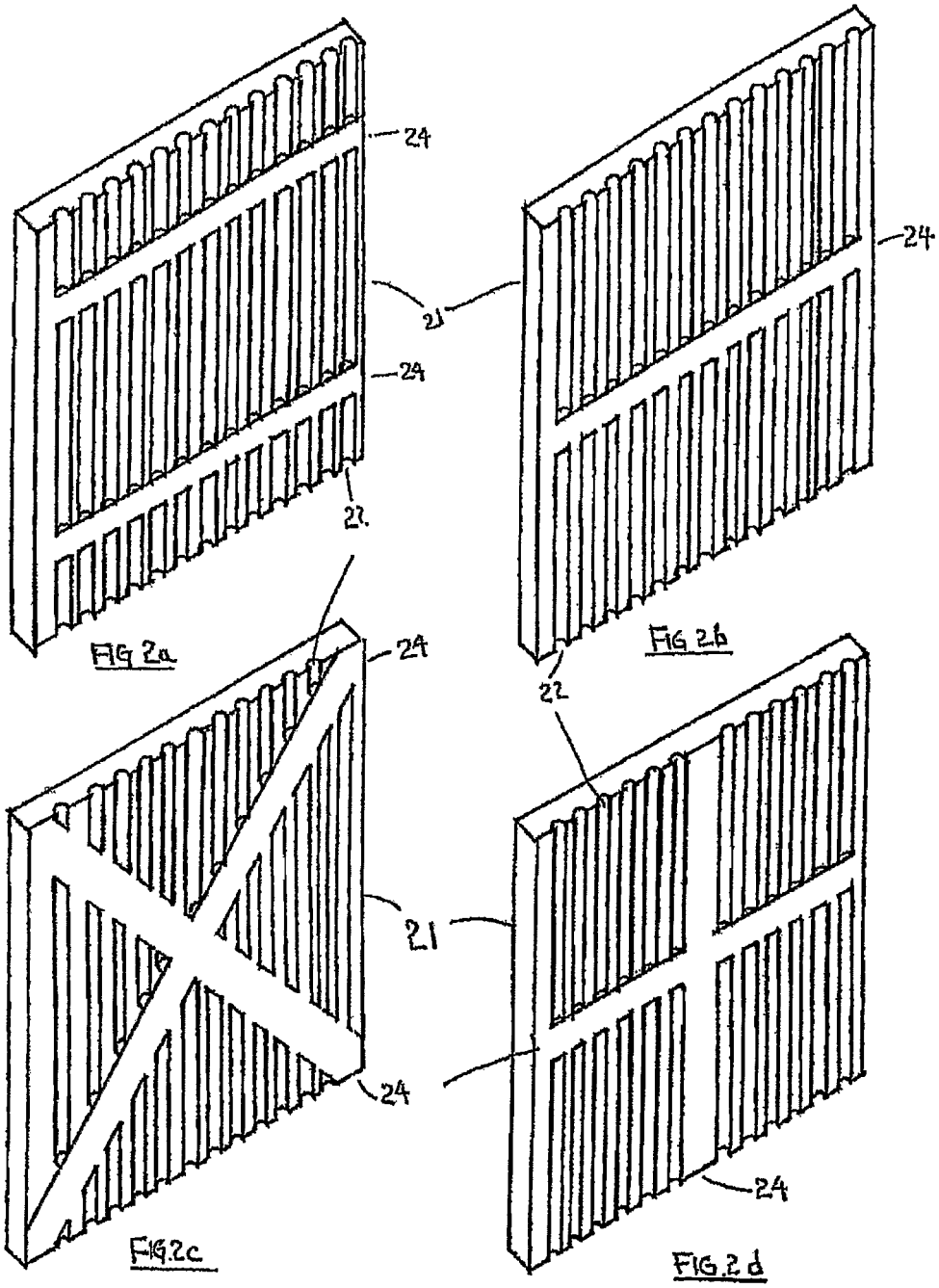
FIGS. 2*a* to 2*d* show various embodiments of one form of the present invention having channels/grooves/recesses and stiffener sections.

In order to produce a door or door/wall board that is both fire rated and waterproof, embodiments of the present invention incorporate cement and gypsum in selected proportions, with a low proportion of cement enough for required waterproofing characteristics. For thin sheets where hardness and strength are required, filler materials like fine sand or calcium carbonate (cc) used as a minimum since these fillers do not bind to the other materials. An example of a preferred composition is 1 part cement to 1 part filler which is stronger than 1 part cement to 3 or 6 parts filler. However, for thicker boards, a higher ratio of fillers can be used, mainly for the following reasons: fillers are usually lighter in density than cement and gypsum; fillers are typically cheap and cost effective.

A door or board according to various forms of the present invention has a composition such that the proportion of cement is reduced to a minimum requirement in order only provide sufficient hardness and waterproofing to the gypsum. Maintaining a low proportion of cement helps to keep down the density, and therefore overall weight for a given board or door, and also to control shrinkage at high temperatures. It has been established that proportions of 1 part cement to 10 parts gypsum and other fillers is sufficient.

To date, boards for walls, partitions or the like, have been flat on both sides because they are screwed or glued to stud work behind the board, and flat surfaces are preferred. For partition or wall boards where security and/or acoustic requirements are important, normally thin boards (9-16 mm) are insufficient due to low inherent strength. Impact, expansion, compressive and/or shear strength are proportional to the density of the board, and whilst solid concrete walls have a density of around 2500 $kgm^{-3}$ or more, most typical boards have a density of around 600-1200 $kgm^{-3}$. However, for security and acoustic requirements, such low density boards need to be very thick and are therefore difficult to handle and transport.

One or more embodiments of the present invention have voids, corrugations, channels, grooves 2 and/or honeycomb 3 arrangement on one side of the door/board 1 to reduce the volume of the material, thus lightening the product, whilst maintaining structural integrity, as shown in the various cross sectional views in FIGS. 1*a*-1*d*. The voids, corrugations, channels, grooves and/or honeycomb arrangement can be provided over an entire side of the door/board or over part of that side.

As shown in FIGS. 2*a*-2*d*, embodiments of the present invention can have the voids, corrugations, channels, grooves and/or honeycomb arrangement extending discontinuously eg over only a portion of one side of the door/board. This is particularly suitable where the door/board is relatively wide. Examples of these embodiments are shown in FIGS. 2*a*-2*d* with the voids, corrugations, channels, grooves 22 and/or honeycomb interrupted at intervals by solid material 24 of the door/board 1 to retain strength as appropriate. The solid stiffener material can be of various arrangements eg diagonal, vertical, and horizontal or combinations thereof. The arrangements having a regular arrangement of indentations, half round grooves/corrugations or honeycomb are considered to provide the most preferable combination of weight reduction with retained inherent strength since these arrangements avoid sharp edges which may otherwise create stress cracks.

Figure 3A:
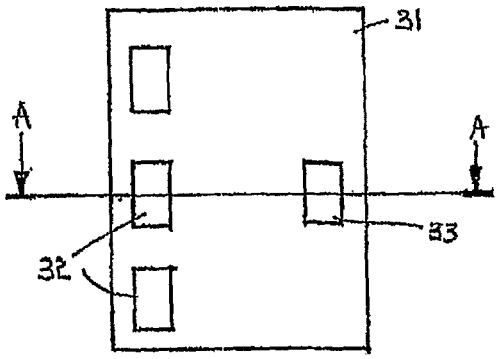
FIGS. 3*a* to 3*b* show embodiments of one form of the present invention including hinge and lock mounting means.
Figure 3B:
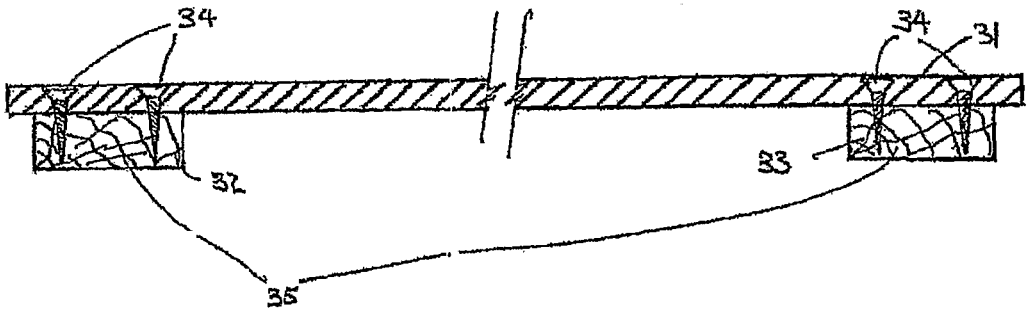

The door/board can incorporate provision for hinges 32 and/or locks 33, as shown in FIGS. 3*a*-3*b*. Timber, metal, ceramic board, fibreglass and or plastic material 35 is mounted to inside (internal to the room, cupboard etc) face of the door/board 31 at various positions, as shown in the cross sectional view in FIG. 3*b* to permit mounting of hinges, such as cabinet hinges, or lock. Countersunk screws 34 are used to attach the material 35 from the reverse side of the door/board by sandwiching the door/board between the screw heads and the material. However, it will be appreciated that other forms of attachment may be used, such as adhesive. Care is taken that the position of the screws mounting the material to the door/board do not interfered with any fasteners for mounting the hinge/lock to the material. The "face fixed" screws are countersunk until recessed and then covered over with putty, filler etc and sanded as required.

Figure 4A:
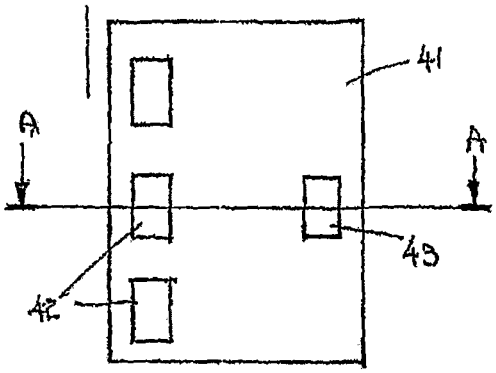
FIGS. 4*a* to 4*b* show embodiments of one form of the present invention including hinge and lock mounting means with optional spacers.
Figure 4B:
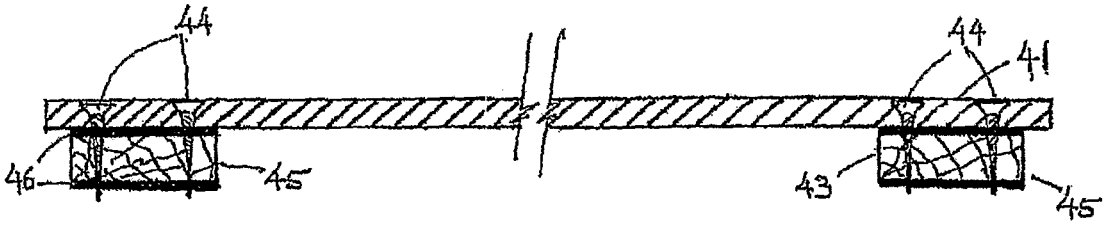

For higher fire ratings, non-combustible material is used for mounting the hinges/lock. In this instance the mounting material 45 can be the same material as the door/board, in which case, since the door/board material does not readily hold screws 44, a thin separator plate 46 eg of metal is sandwiched between the mounting material 45 and the door/board 41, as shown in FIGS. 4*a*-4*b*.

By using small pieces of material, the weight of the door board can be vastly reduced.

However for larger sized cabinet doors 51 a skeleton or framework 52 is required to add stability to the door and provide rigidity and stiffness, depending on the fire rating, many designs and variations for the skeleton/framework are possible. (Examples are shown in FIGS. 5*a*-5*f*. The skeleton/framework will be of suitable thickness, width and material (timber or ceramic) running along the whole height and width of the board. They will be secured to the board with face fixed countersunk screws 54 at regular intervals to give even support (FIG. 5*g*). The skeletons/framework can be glued to the door/board 51 for more strength.

In the embodiments shown in FIGS. 6*a* through 8*b*, cabinet hinges 64*a*,64*b*,74*a*,74*b*,84*a* and 8*b* are provided respectively. Various hinge to door mounting provisions are shown. The cabinet hinge advantageously permits the door to open beyond a typical 90 degrees. Even up to a near 180 degrees is possible, though generally it is envisaged that up to 135 degrees would be a typical application. The cabinet hinge permits the door to open without contact with an adjacent closed door. Also, the cabinet hinge is concealed from the outside when the door is shut, thus providing not only a pleasing visual effect of continuous cabinets and doors, but also a protection from fire, heat and moisture when the door is shut. This is particularly advantageous in high fire risk areas, such as equipment cabinets eg electrical cabinets, or in high water/humidity conditions such as in the tropics/sub tropics or high rainfall. The ceramic door provides heat and fire resistance to the cabinet and hinge therebehind, whilst the concealed cabinet hinge provides concealed support to the door. In addition, the hinge side edge of the ceramic board door can be allowed to overlap the front side edge of the cabinet, thereby providing additional fire, heat and moisture protection to the cabinet, thus reducing the risk of additional fire from the cabinet burning. The ceramic door provides additional fire protection to the home and business by reducing the amount of likely overall fire or water damage to fixtures and fittings behind the door, whilst also protecting the contents of the space behind the door.

Figure 6A:
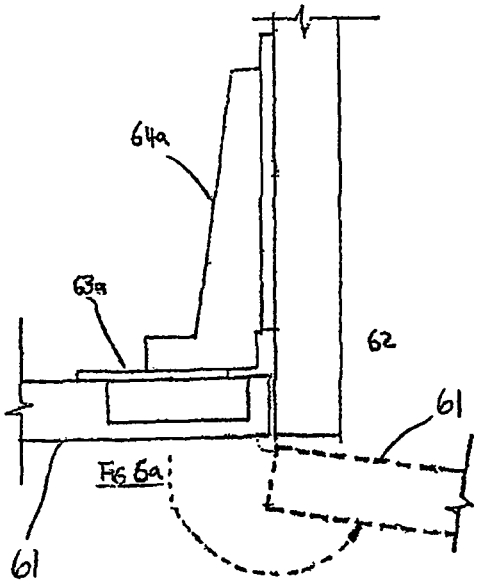
FIGS. 6*a* and 6*b* show alternative inset and overlap door embodiments of one form of the present invention.
Figure 6B:
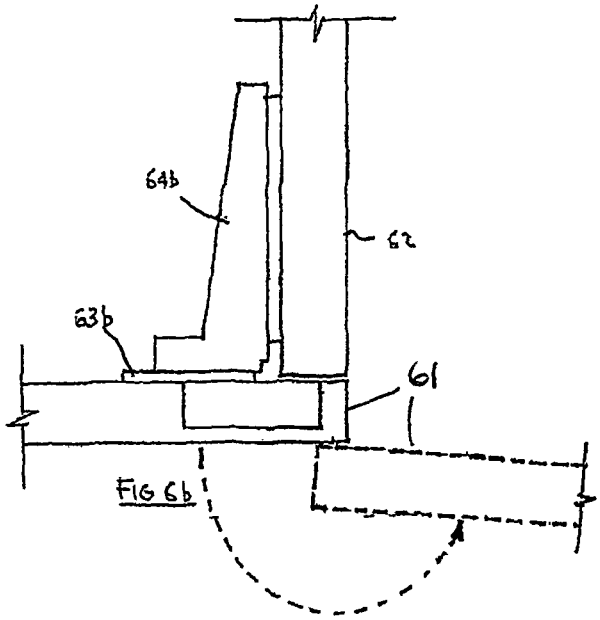

FIGS. 6*a* and 6*b* show alternative arrangements for mounting the cupboard door 61 either inset as shown in FIG. 6*a* or overlay as shown in FIG. 6*b* with respect to the cabinet 62.

In cases where fire rating is required, the skeleton/framework 73 would be important, because the door/board 71 is too thin and there would be no rebate and frame to help stop the fire.

Figure 7A:
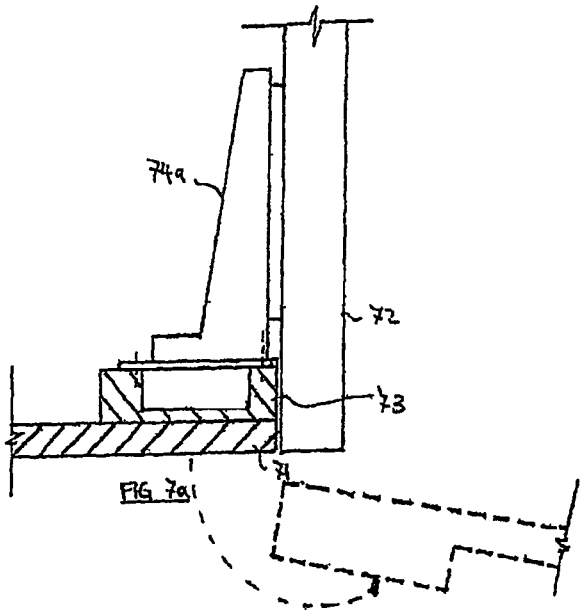
FIGS. 7*a* and 7*b* show alternative arrangements of embodiments of the present invention applied as a door for a cabinet.
Figure 7B:
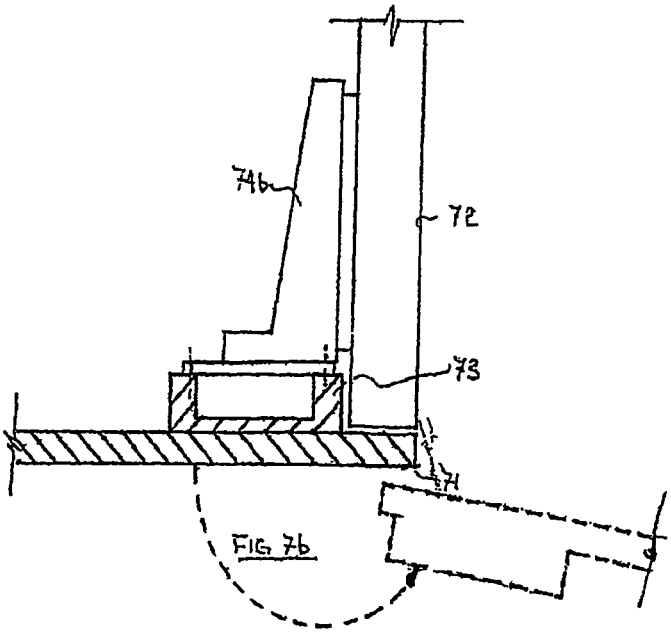

For inset applications (FIG. 7*a*), the cupboard door 71 is inset with respect to the cabinet 72 and the skeleton/framework 73 can be located at the edge of the door/board. Whereas, for full overlay applications the skeleton/framework 73 will be set back from all the edges of the board (FIG. 7*b*).

Figure 8A:
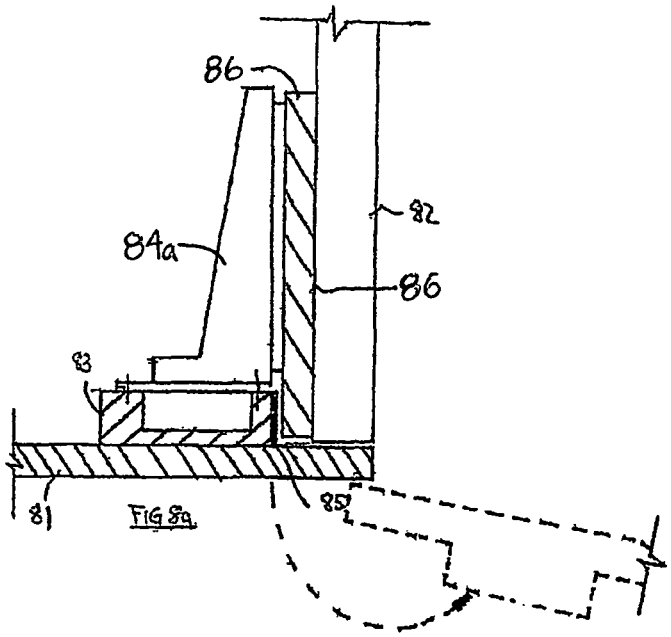
FIGS. 8*a* and 8*b* show alternative overlap and inset door embodiments of one form of the present invention including additional spacer material between supporting side wall and stop, and intumescent seal.
Figure 8B:
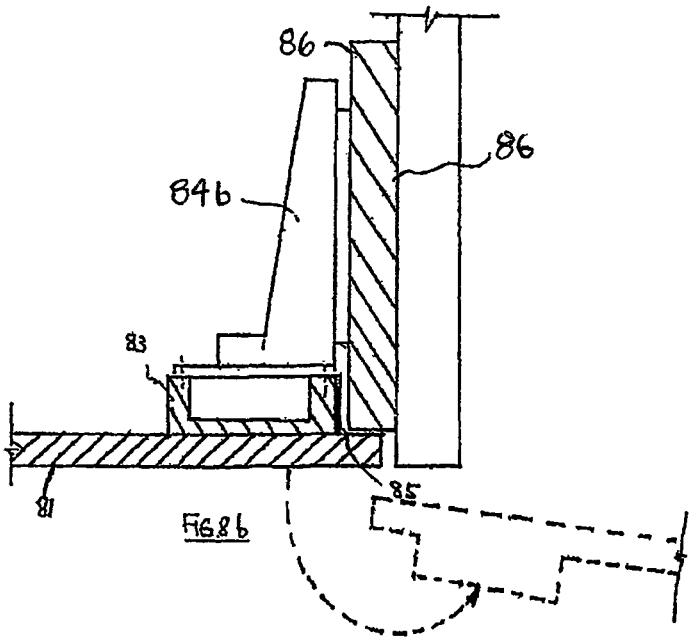

To further improve the fire rating, as shown in FIGS. 8*a* and 8*b*,a small timber/ceramic "frame" 86 can be added to the inner walls of the cabinet 82, where the cabinet hinges are located and preferably all along the internal perimeter of the cabinet or at the two verticals, i.e., lock and hinge side. In this embodiment, the cupboard door 81 may be inset or overlay with a skeleton/framework 83.

Preferably, a 10-30 mm thick "frame" 86 will be used. This "frame" 86 serves to provide a rebate or recess for the board 81 to snugly fit into and creates a stop for the passage of fire.

When no smoke or high furnace pressure is used, a fully ceramic board will suffice.

For cases where the furnace pressure is high, intumescent seals 85 will be needed along the cabinet door perimeter.

The intumescent seals 85 can be on the board edge or skeleton/framework edge—depending on the various thickness selected, but it would be advantageous to locate them on the skeleton 83 as it is recessed and hidden from view, compared to the board edge which may be thinner than the intumescent seals width.

As intumescent seals expand when heated, the seals must be installed perpendicular to the board face so that all expansion forces are exerted parallel to the board face—thus sealing the gaps.

It is not advisable to install intumescent seals parallel to the board face as the expansion forces will only serve to push the board 81 out of the cabinet 82 or "frame" 83.

As the ceramic board may weigh more than conventional cabinet doors, more hinges may be used to carry the extra load.

The ceramic boards are secured face screwed, and later the countersunk heads putty and sanded. This can also apply for using it as a cabinet door. However, being a door, not a fixed non-moveable wall, there is a likelihood that with the opening/closing and banking impact cabinet doors are subject to, the putty/screws will show cracks, fall off (putty) over time. Although, structurally, the cabinet door is still operable, visually, these cracks etc., would be seen all over the cabinet door face.

The solution is cosmetic, by:

1. use thicker paint—preferably textured coatings,
2. laminate a thin wood veneer, wallpaper, high pressure laminates,
3. add an additional ply, ceramic board to the face to conceal these screws.

With adhesions improved, the need for mechanical fixings like small head screws is not so critical. For instance when nails are still required, only elastic materials which can "grip" the small head nail's shaft for strength can be used. For this purpose, 1-3 mm thick nail provisions can be embedded in the ceramic board, preferably along the centre line of the board's thickness. The best materials that give elasticity and therefore grip are plastics, ABS, PVC, polycarbonate. The nail provisions can be a whole sheet sandwiched between the ceramic material, i.e., a 1-3 mm plastic sheet (with perforation corrugations, nettings attached), or "keys" imprinted in the plastic to ensure the ceramic board does not delaminate, or only located at a specific place.

When the nails are punched through a ceramic board with the nail provisions, it would be the centre plastic that would grip the nails.

FIGS. 6*a* to 8*b* show the door panel 61,71, and 81 respectively in a closed position, with a representation in phantom lines showing the door panel opening on the cabinet hinges 64*a*,64*b*,74*a*,74*b*,84*a* and 84*b*. Although not explicitly shown, a portion of each cabinet hinge extends hingedly outwardly with the opening door, and allows the door to open beyond 90 degrees, as shown.

Thus, the door board or wall board can include a relatively thin membrane, sheet or one or more strips or portions of an elastomeric material sandwiched between two sheets of ceramic board. The elastomeric material helps to retain fasteners, such as nails and screws, when attaching the door board to a support structure such as a preinstalled door, skeleton frame or the like.

Figure 9A:
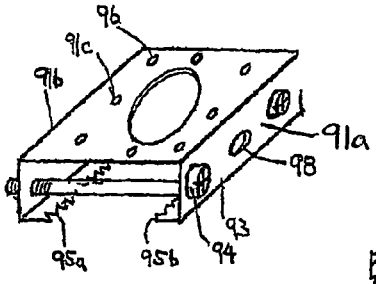
FIGS. 9*a* and 9*b* show an embodiment of a further form of the present invention in the form of a clamp system for mounting a hinge, lock or the like to a ceramic board.
Figure 9B:
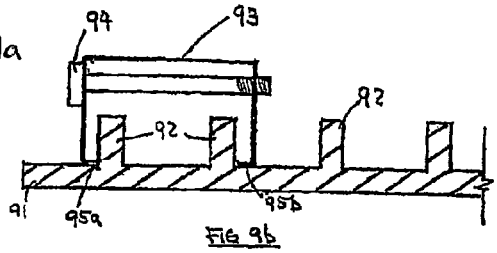

FIGS. 9*a* and 9*b* shows a metal clamp or holdfast 93 embodiment, for attachment to fins/ribs/webs 92 projecting from the board 91. The fins/ribs/webs 92 provide additional stiffness, anchor points for the clamp 91, and gaps therebetween for incorporating lightweight filler (see FIG. 10). The clamp has opposed jaws 95*a*, 95*b* which can be brought closer together or moved further apart by rotating a screw thread adjuster 94. The sides 91*a*, 91*b* of the clamp can include apertures for accommodating high temperature restraints. The main face 91*c* of the clamp includes predetermined holes 96 to suit attachment of hinges as appropriate. As shown in FIG. 9*b*, the clamp is applied over two adjacent fins/ribs/webs 92 and the adjuster means 94 rotated until the jaws close sufficiently together to grip the fins/ribs/webs 92. The clamp 93 is thereby held fast attached to the board 91 and a hinge or lock etc can be mounted to the clamp 91. The clamp 91 may span more than two adjacent fins/ribs/webs 92 and may include more than one set of opposed jaws. Also, the adjuster means need not be a screw means but could be provided by a ratchet etc.

Figure 9C:
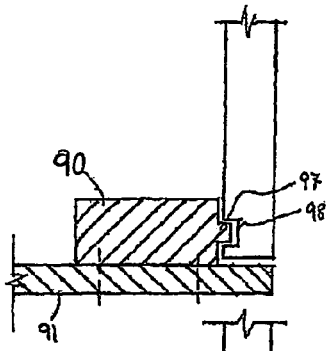
FIGS. 9*c* to 9*e* show embodiments of high temperature restraint means applied to a door or board according to one or more forms of the present invention.
Figure 9C:
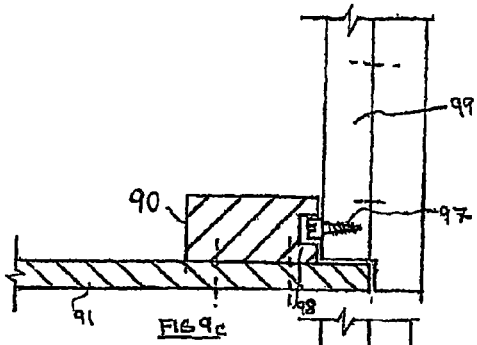
Figure 9E:
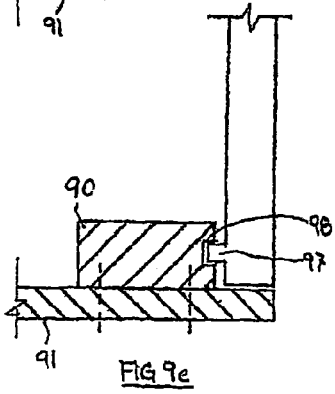

FIG. 9*c* shows a built in high temperature restraint 97 in the form of a metal projection which engages into a recess 98 in the hinge mounting portion of the door 91 or skeleton frame 90. The restraint 97 and recess 98 may be transposed so that the restraint 97 is provided on the cabinet/wall board and the recess on the door hinge mount plate. Additional material 99 may be applied to the inside face of the cabinet as additional framing. Thus, should the door assembly be subjected to fire and extreme heat such that alloy hinges melt and/or fail, the door will remain substantially in a closed position, held closed by the restraints 97. Thus, advantageously, the restraint (s) additionally protect the interior space and anything within in the event that the hinges fail. FIG. 9*e* shows alternative kinematic inversions of arrangements of the restraint utilising a member 97 extending into a recess or channel 98 on the cabinet side.

Figure 9D:
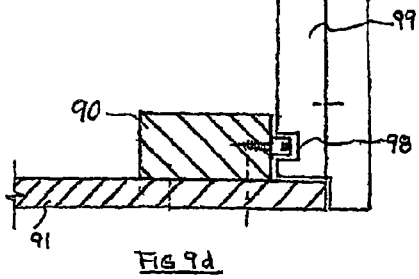

Alternatively or in addition, FIGS. 9*c* to 9*d* show kinematic inversions of the restraint with a screw threaded member 97 extending into either the door or cabinet side, with the head of the member extending into the recess or channel 98, thereby holding the door closed in the event of hinge failure.

Figure 10A:
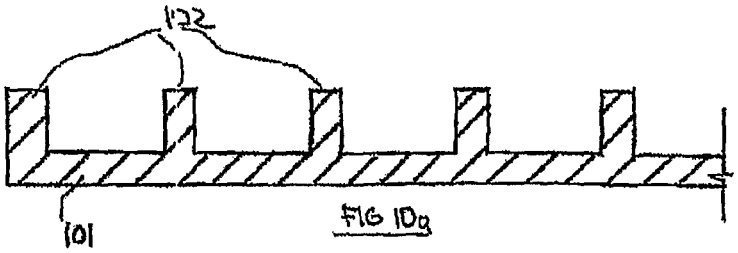
FIGS. 10*a* to 10*c* show various embodiments of an alternative form of the present invention including fins/ribs/webs of material creating channels/grooves.
Figure 10B:
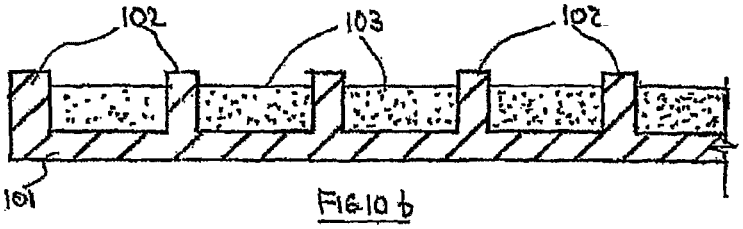
Figure 10C:
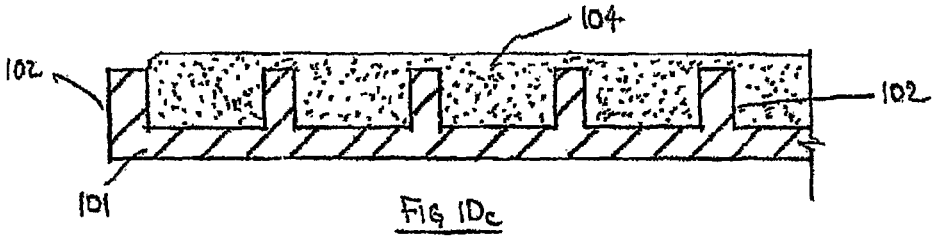

The door/wall board 101 shown in FIG. 10 includes fins/ribs/webs 102 of material extending from the plane of the board. The board has a reduced thickness 'T' compared with other embodiments of the present invention. FIG. 10*b* shows the board 101 with a lightweight filler 103 introduced between adjacent fins/ribs/webs 102 which adds rigidity to the board without greatly increasing overall weight. The filler material can be fire retardant/proof. FIG. 10*c* shows an alternative arrangement to that shown in FIG. 10*b* though with additional lightweight filler 104 in the form of polyurethane, styrene foam, lightweight cement and/or ceramic fill, and extending deeper than the height of the fins/ribs/webs.

In order to prevent jagged/chipped edges for doors subjected to heavy and rough use, door protectors can be used, as exemplified in FIGS. 11*a*-11*d*.

The protector can be of metal, plastic, timber. If fire rating is required, an intumescent seal can be embedded within the door protector.

To help ensure that edges of the ceramic board are not chipped or damaged, door protectors can be used.

Figure 11A:
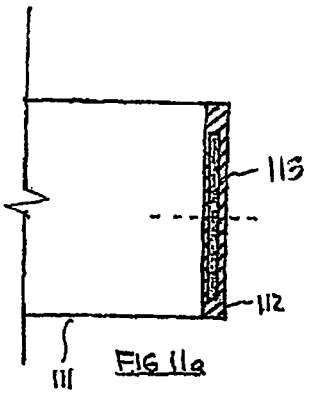
FIGS. 11*a* to 11*d* show various embodiments of one form of the present invention including protective end cappings.
Figure 11B:
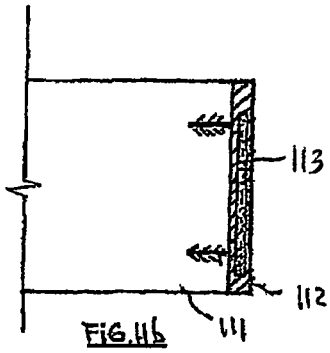
Figure 11C:
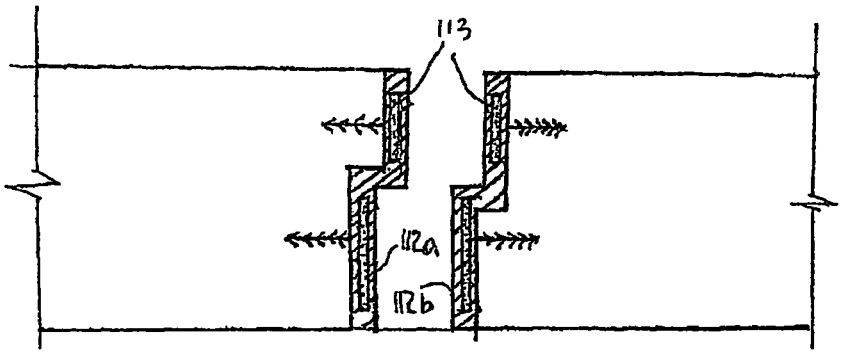
Figure 11D:
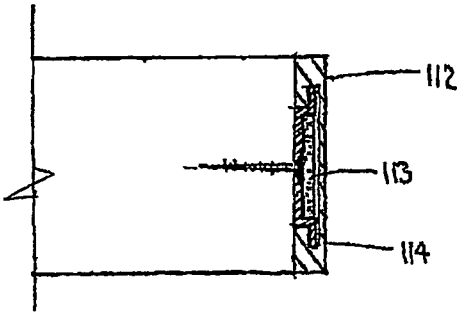

FIGS. 11*a* to 11*d* show alternative arrangements of protective end or edge caps 112, 112*a*, 112*b* for the door 111. The protectors 112, 112*a*, 112*b*. as shown in FIG. 11*c*-11*m* consist of metal, plastic or rubber material attached to the door edge. Attachment is by nail/screw fixing (FIG. 11*a*), slot in via integral, preferably barbed, protrusions (FIG. 11*b*), overlapped slot in (FIG. 11*c*), and can include a concealed intumescent seal 113 as shown in FIG. 11*d*.

As shown in FIGS. 11*e* to 11*m*, the cabinet door edge protector 112, 112*a*, 112*b* can include an attachment portion, eg in the form of a 'sandwich' component 116. The protector 112 can be adapted for left or right handed applications, and can be manufactured for use where the ceramic board forming the door front overlaps i.e. extends beyond the hinge/lock support piece or part of the skeleton or framework 115, as shown in FIG. 11*i*. Alternatively, the edge protector 112 can be arranged for use where the ceramic board 111 and support 115 provide a flush edge, as in FIG. 11*k*.

The protector 112 can extend to protect just the edge of the door/board 111, as shown in FIG. 11*i* for example, or can in addition also extend as a double protector to protect the support/frame work, as shown in FIG. 11*k*. For such double protectors, the protector can be stepped (see FIG. 11*e*) to allow for the ceramic door board to overlap or underlap the support/framework.

The protector 112 can include an intumescent seal 117 material within the material of the protector. The amount or thickness of the intumescent material can vary depending on the fire rating. At high temperatures, the intumescent seal will expand to seal the door edge to an adjacent cabinet board, wall or adjacent door edge in the case of double doors. The protector 112 can include projections, such as barbs or fins 120 (FIGS. 11*g* and 11*h*), to assist in positioning and retaining the protector to the door edge e.g. positioning the projections 120 between the back of the door board 111 and the support material 115.

A portion of the protector 112 can act as a sandwich piece 116 for positioning between the support material 115 and door board 111 (see FIG. 11*i*). Fastening means, such as screws or nails 118, may be used to attach the support material 115 to the door board 111 through the sandwich piece 116.

The single type protector (door edge only) and double type (door and support material edges) can be used for double door applications, as shown for example in FIGS. 11*l* and 11*m*. FIG. 11 m shows the support material 115*a* of one door 111*a* overlapping behind the door protector of an adjacent double door 111*b*. The arrangement shown in FIG. 11*l* uses single type protectors 112*a*,112*b*. However, as shown in FIG. 11*m*, double type protectors 112*a*,112*b* can be used where the protector is also to cover an edge of the support material 115*a*,115*b*. As shown in FIG. 11*m*, the edge protector 112*a*, 112*b* may or may not have a sandwich piece 116 depending on the application required.

The intumescent seal material 117 can be provided in both portions of a double edge protector as two separate intumescent seals 117*a*,117*c* or 117*b*,117*d*. Alternatively the intumescent seal material can extend continuously to form a single seal material within a double protector. As in cabinet faces, it will be preferable to purpose to make ceramic boards or to make doors without the need to add ply/facings/decorations and to face screw the board. This can be achieved by adding protruding fins/channels on one side of the board.

By putting two similar boards together with fins/ribs/webs facing inwards, a door is very quickly made.

The length and thickness and frequency and spacing of the fins, ribs, webs can vary to suit the application for light duty, the fins do not meet, whereas in rough/heavy use, overlapping fins/ribs/webs will be needed, the overlapped fins/ribs/webs are glued to the corresponding fin/rib/web on the other side.

The fins/ribs/webs can be of similar material as the board or metal/plastic embedded.

The edges of the door will be cut to accommodate timber/metal/plastic framework/skeleton. By varying the width of the skeleton, the door thickness can also be varied.

The fins/ribs/webs allow also for mechanical fitting to the skeleton and other requirements without having to face screw. The skeleton is then glued and screwed in place.

For wider boards, horizontal fins/ribs/webs would add rigidity and stability. The edges can also use the door protector discussed above.

The boards can be provided in colours and moulded with textures to suit.

Figure 12A:
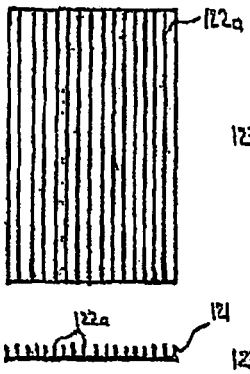
FIGS. 12*a* to 12*e* show various embodiments of an alternative form of the present invention in respect of boards and doors formed with fins/ribs/webs.
Figure 12B:
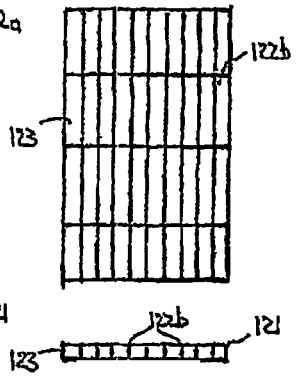
Figure 12C:
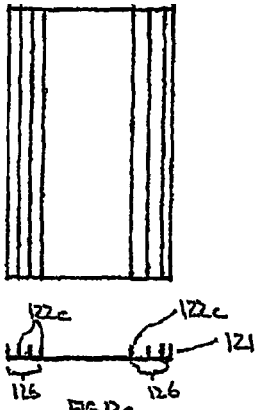

FIGS. 12*a* to 12*e* show front view and corresponding sectional views of various arrangements of fins, ribs or webs 122*a*-*e* of the board 121. FIG. 12*a* depicts fins/webs 122*a* extending from the plane of one face of the board and running vertically. FIG. 12*b* shows similar vertical fins/webs 122*b* in combination with additional horizontal fins/webs 123. The fins/webs 122*c* in FIG. 12*c* extend only adjacent the side edges 126 of the board 121.

Figure 12D:
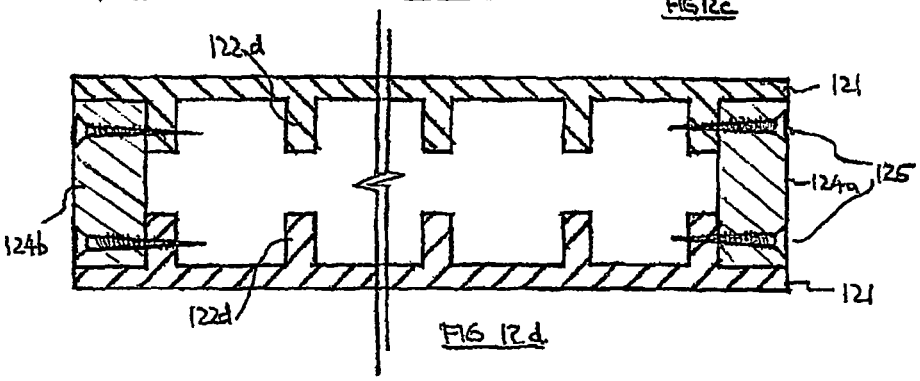
Figure 12E:
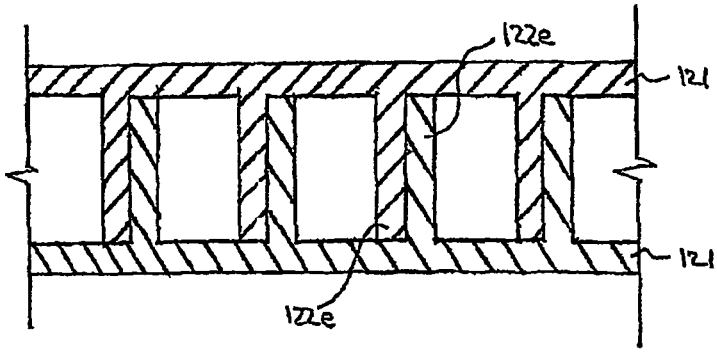

In FIG. 12*d*, two boards 121 are arranged back to back with their respective face sides outwards such that their fins/webs 122*d* at edges of each board are connected together by fastening a support material, eg plastic, metal or wooden block 124*a*, 124*b*, to the edge-most fin/web of each board. The support material may be fastened by screws, as in screws 125 in FIG. 12*d*, or nails, adhesive or any combinations thereof The support material 124*a*, 124*b* may vary in thickness depending on the required overall final thickness of the door. FIG. 12*e* shows an alternative arrangement for connecting together the fins/webs 122*e*by overlapping the fins/webs and joining together with adhesive.

In respect of the telescopic partition/wall/door embodiments—for areas where it is desired to have a discreet moving door or partition that can be moved into place or slid away when not in use, a telescopic door/partition is provided. This is particularly efficacious where an opening for a passageway is much wider than the wall next to it, it would not be possible to hide a sliding board of say 1-6 meter wide in a 1 meter wide wall.

In cases like this, traditionally, 2 tracks and 2 separate boards are used where the boards are stored face to face, side by side, and a relatively wide track is required so that both boards can slide along their own section of track. This requires a substantial depth of space to store doors/boards side by side in this way.

Figure 13B:
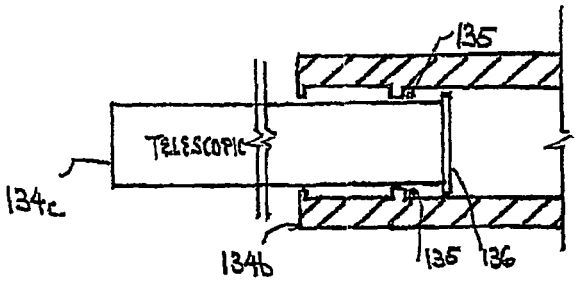
FIGS. 13*a* to 13*c* show various embodiments of a further form of the present invention in relation to a telescopic door/board system.
Figure 13A:
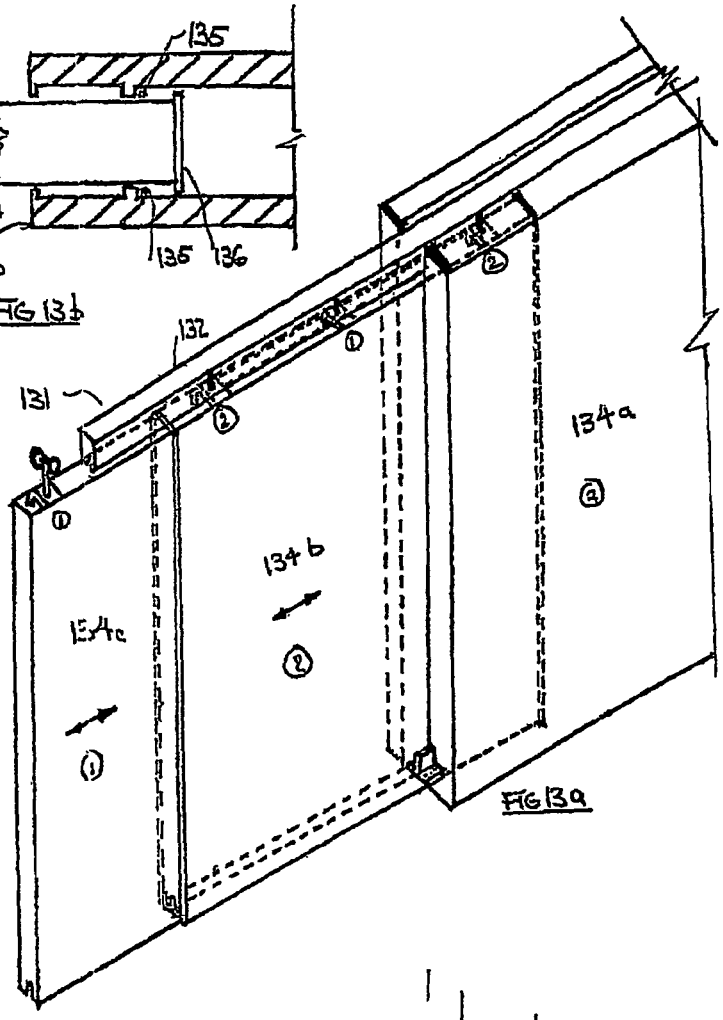
Figure 13C:
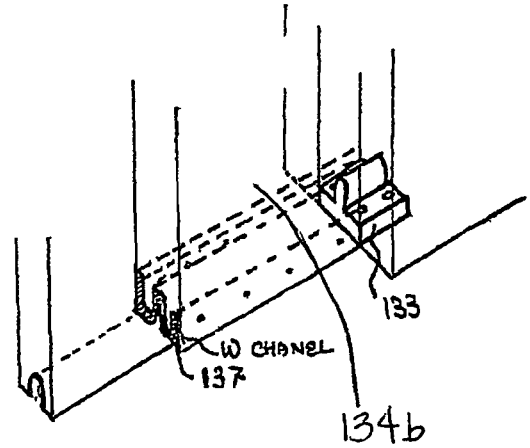

FIGS. 13*a-c* show an arrangement of the telescopic door/partition system 131 according to a form of the present invention. This uses a single overhead track 132 and floor mounted guide 133. The arrangement shown has a fixed board 134*a*, a middle first sliding board 134*b* and an end second sliding board 134*c*. The second board 134*c* telescopes into/out of the first board 134*b*, which itself telescopes into/out of the fixed board 134*a* along the track 132. Since both boards 134*b* and 134*c* share the same linear track 132, the track and over system can be narrower. It will be appreciated that the arrangement of the telescopic door/partition defined and described herein may include more boards to suit the required opening width.

FIG. 13*b* shows an acoustic compression seal 135 in position between the inner faces of the receiving board 134*b* and the outer faces of the telescoping board 134*c*. The rear edge of the telescoping board 134*c* includes a flanged stop means 136 to prevent over-extension of the door/partition.

FIG. 13*c* shows a "W" 137 channel arrangement on the bottom edge of the first board (receiving board) 134*b*. This W channel guides the second board 134*c* to slide in the upper portion of the W section and the floor guide 133 to pass during relative motion of the board 134*b* and floor guide 133 under the W section. To help avoid unsightly floor track, the middle board has a W section bottom edge which allows the floor guide to guide it. Thus, the special bottom track allows in line travel of the boards. For acoustic purposes, seals 135 are positioned in the joint between the telescoping boards so that they can contact and seal when closed. For security purposes, a 100-150 mm overlap between the closed boards is maintained. The boards in this embodiment are formed of ceramic boards to which a decorative laminate, print or paint can be applied. For a 3 board system with 2 moving boards, four sliding gears would be used (two for each board).

A further form of the present invention provides a telescopic sliding door or partition system comprising at least first and second coplanar boards, the first board having a recess for receiving at least a portion of the second board, and a track for slidably mounting the boards thereon, such that, during relative motion of the respective boards along the track, the second board is received into the recess during opening movements of the door/partition and extends from the first board during closing movements of the door/partition.

Thus, the telescopic door/partition provides a convenient and practical means for separating two areas or closing off a room/space whilst requiring reduced space. With one board received in the other board when the door/partition is open, less overall thickness of the system is needed compared to known sliding door systems where the doors are arranged in side by side parallel planes when open. Furthermore, prior art systems generally require a separate track for each door, whereas the telescopic door/partition system can utilise a single coplanar track arrangement leading to a neater more efficient and cost effective system.

Figure 14F:
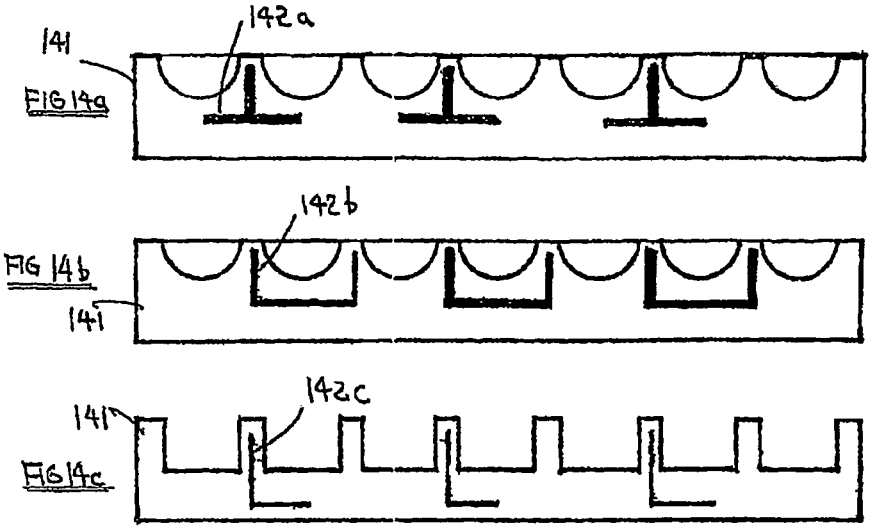
FIG. 14*f* shows the skeleton members positioned horizontally across a ceramic board according to an embodiment of the present invention.
Figure 14F:
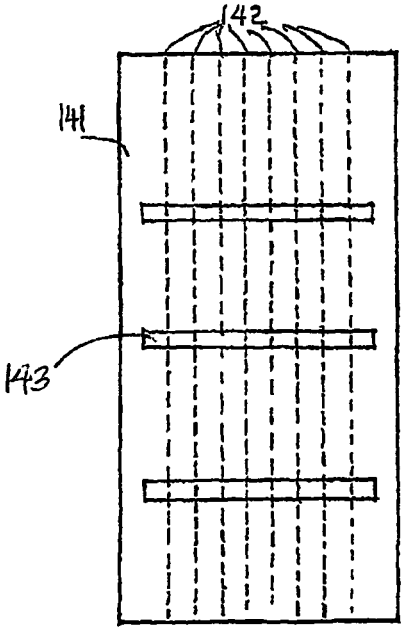
Figure 14E:
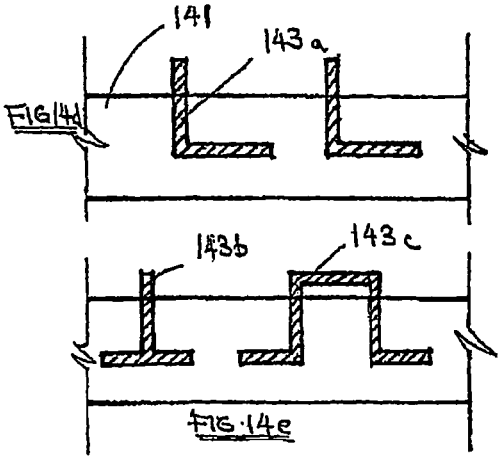

FIGS. 14*a* to 14*c* show cross sectional views of embodiments of the ceramic board including discrete internal strengthening elements 142*a*,142*b*,142*c* respectively, extending along the length of the board. The elements 142*a*,142*b*, 142*c* may be continuous running substantially the length of the board or may be discontinuous, and may overlap. The elements may be contained entirely within the material of the board, or may be exposed to atmosphere on one or more faces of the board, and may extend to be exposed at one or both ends of the board in the direction of the elongate length of each member, as shown in FIGS. 14*d* and 14*e*.

The board/door 141 can also include additional horizontal strengthening members 143, which can be mounted externally to the face of the board/door, or can extend into the material of the door, and preferably may connect to one or more of the internal strengthening elements.

Figure 15A:
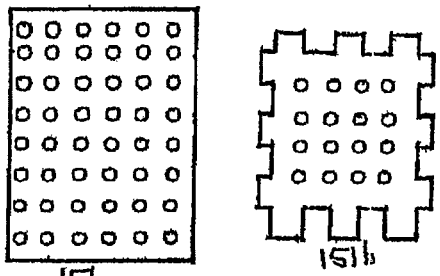
FIG. 15*a* shows fixing reinforcement plates for use with embodiments of the present invention.
Figure 15B:
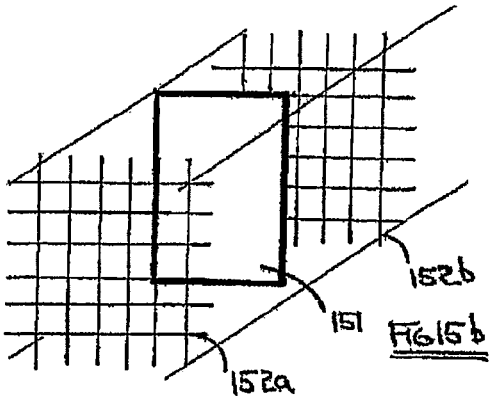
FIG. 15*b* shows a sandwich arrangement of fixing reinforcement for use with embodiments of the present invention.
Figure 15C:
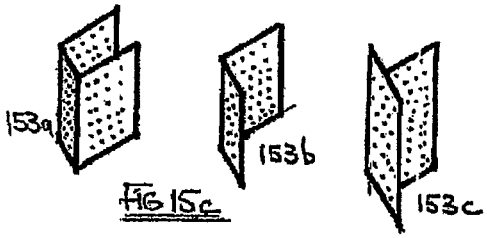
FIG. 15*c* shows alternative arrangements of the fixing reinforcement.
Figure 15D:
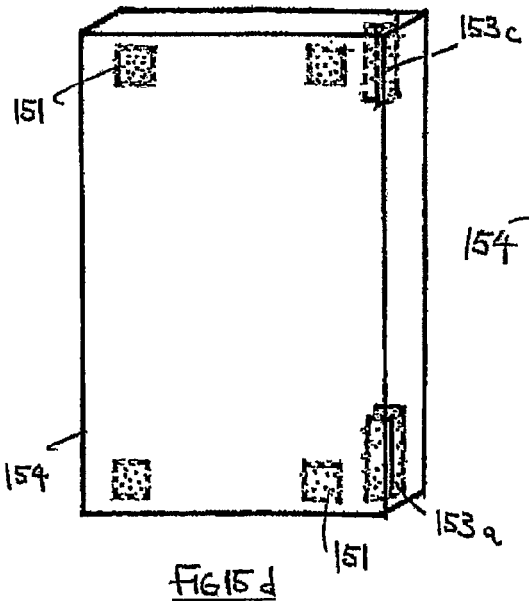
FIG. 15*d* shows a ceramic board according to an embodiment of the present invention including fixing reinforcements.

FIGS. 15*a* to 15*e* show applications of support members 151 and edge strengtheners 153 applied to the ceramic board/door 154. The support members 151 can be generally in the form of flat plates or corrugated plates, and can have holes and/or serrated edges to provide enhanced grip properties when mounting to or into the material of the board/door. Holes may be provided for receiving fastening means for attaching other objects such as hinges, locks etc. The support and/or edge strengthener can be attached or bonded in the material of the board by sandwiching between sheets of mesh 152*a*, 152*b* material which assists adhesion to the ceramic material of the board/door, as shown in FIG. 15*b*.

Figures 5A, 5B, 5C, 5D, 5E, 5F:
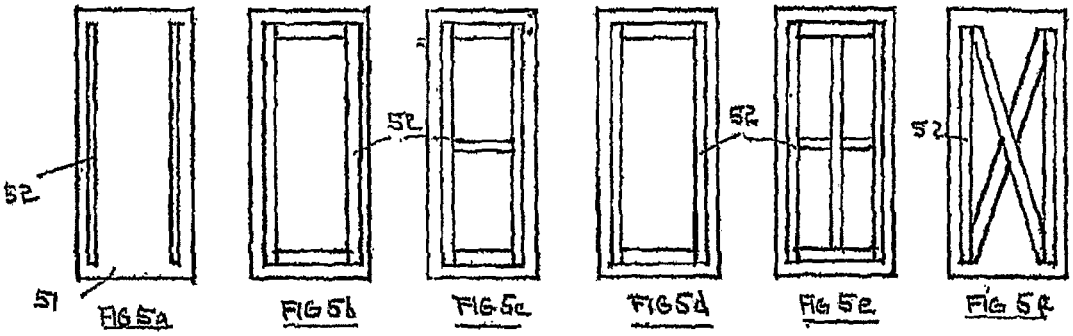
FIGS. 5*a* to 5*g* show various embodiments of one form of the present invention including supporting 'skeleton' framework.
Figure 5G:
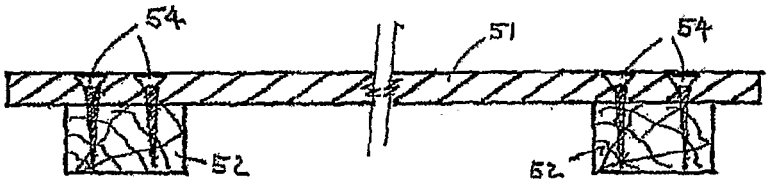

The edge strengtheners 153*a* and 153*c*, as seen in FIG. 5*d*, can be used to mount hinges, locks etc. The edge strengtheners can be 'T', 'U' or 'L' shaped in section.

Figure 15E:
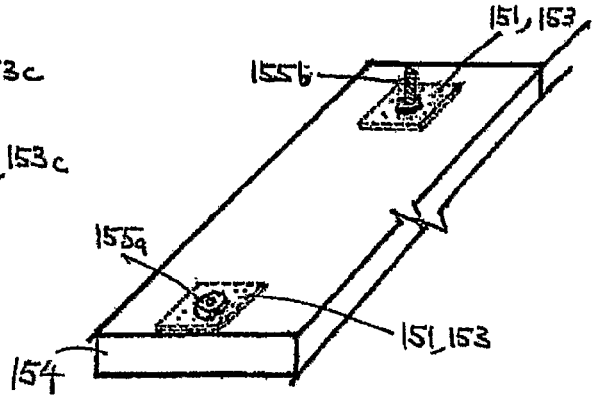
FIG. 15*e* shows fixing reinforcement within a portion of a ceramic board in an embodiment of the present invention.

As shown, for example, in FIG. 15*e*, the plate 151,153 can be embedded into the board/door panel 154 and can be used to retain a fastening means, such as a fixed nut 155*a* or threaded fastener 155*b*. it will be appreciated that other fasteners may be attached to the plate.

Figure 16A:
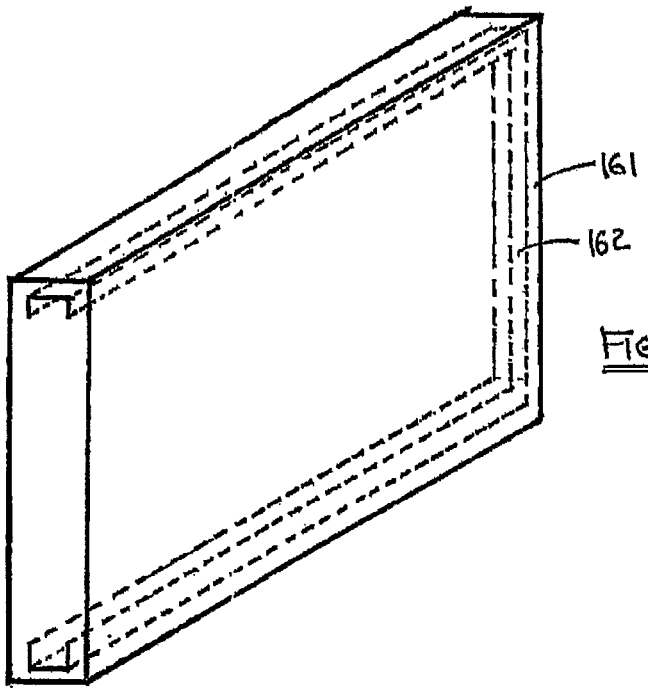
FIG. 16*a* shows reinforcement embedded into the ceramic material of a board/door of an embodiment of the present invention.
Figure 16C:
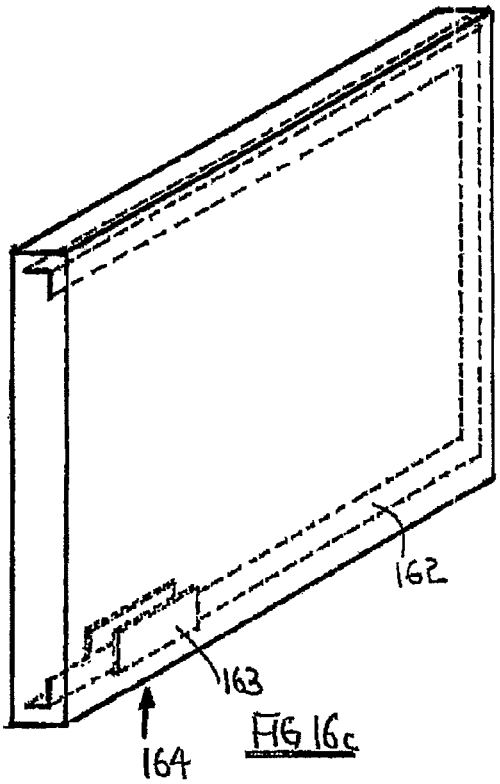
FIGS. 16*b* and 16*c* show a fixing reinforcement applied to an embodiment of the present invention.
Figure 16D:
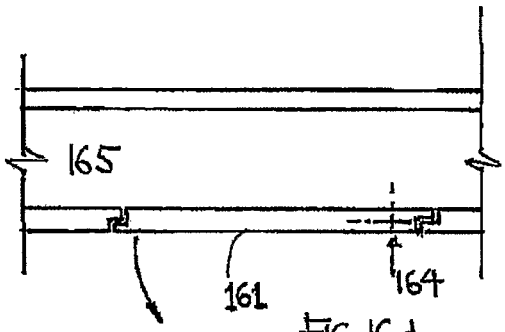
FIG. 16*d* shows a ceramic board/door according to an embodiment of the present invention utilised to provide a pivotable wall panel for a cavity wall.
Figure 16B:
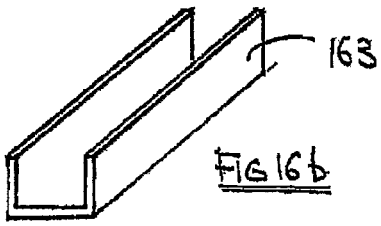

The board/door 161 as shown in FIGS. 16*a*-16*c* for example, can be provided with an internal support structure 162, which can be in the form of elongate members running within the material of the periphery of the board/door. The elongate members may be "L", "T" or "U" shaped. Alternatively or in addition, a support structure can be mounted to the external periphery of the board/door (not shown). The board/door can be supported on a fixing reinforcement means 163 (FIG. 16*b*) in the form of a channel section member. This can act as or be supported on a pivot point 164 for hinging the board/door, as shown in FIG. 16*c*. The board/door can be supported by the reinforcement means via supporting channel sections 162.

The board/door 161 can be pivotably or slidably mounted to act as an access panel/door into a recess or cavity wall 165, or another room, as shown in FIG. 16*d*. For example, the cavity wall may have cables, equipment, pipes etc therein and the openable wall/door panel of ceramic material provides a fireproof and waterproof wall panel that also advantageously allows access to the equipment etc.

Figures 17A, 17B, 17C:
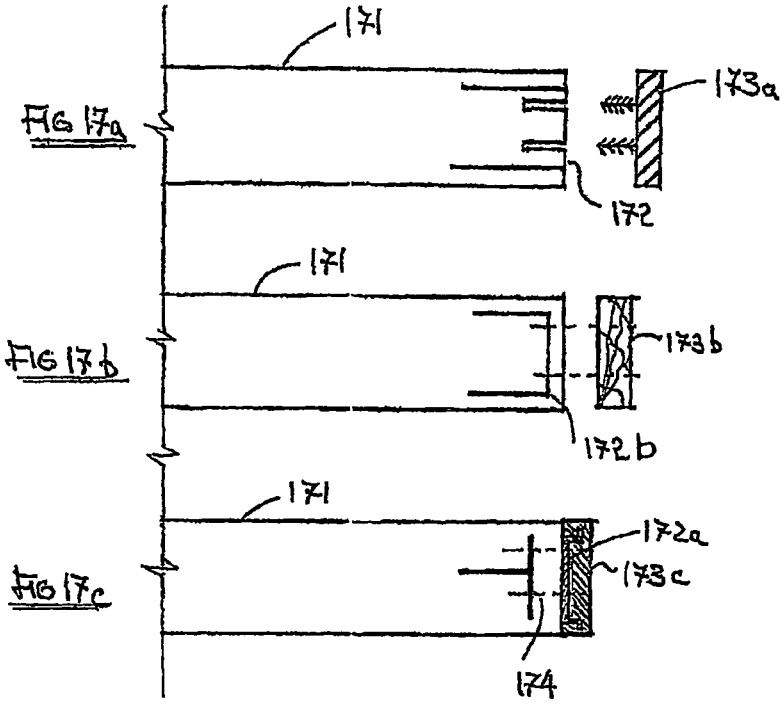
FIGS. 17*a* to 17*c* show alternative forms of an edge protector and mounting means therefor, including a ceramic board/door according to an embodiment of the present invention.

There may also be provided an edge protector for the ceramic board/door, as shown in FIGS. 17*a* to 17*c*. The ceramic board/door 171 can have an edge protector mount 172 cast therein, as in FIG. 17*a*, whereby the edge protector 173*a* is attached to the mount 172. Alternatively, the edge protector can be fastened by discrete fixings, such as nails or screws, to a support 172*b* embedded in the material of the board/door, as shown in FIG. 17*b*. Another arrangement shown in FIG. 17*c* provides a mounting means 172*a* affixed to an external edge of the board/door, and the edge protector 173*c* attaches thereover eg clips or friction fits thereto.

Figure 18A:
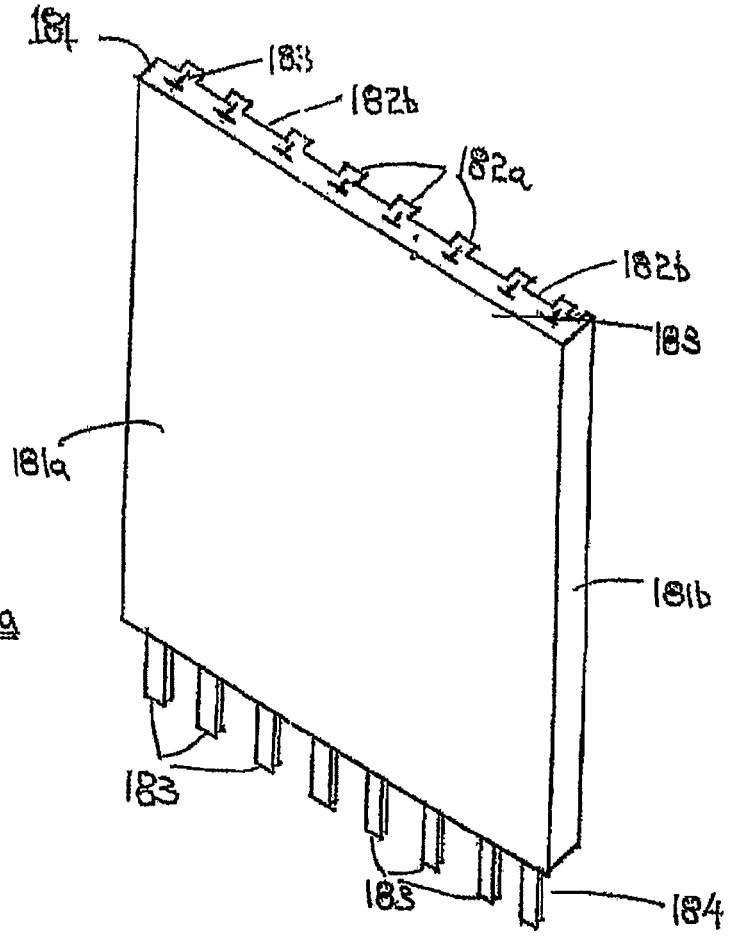
FIGS. 18*a* and 18*b* show an embodiment of the present invention including integral strengthening and recess.
Figure 18B:
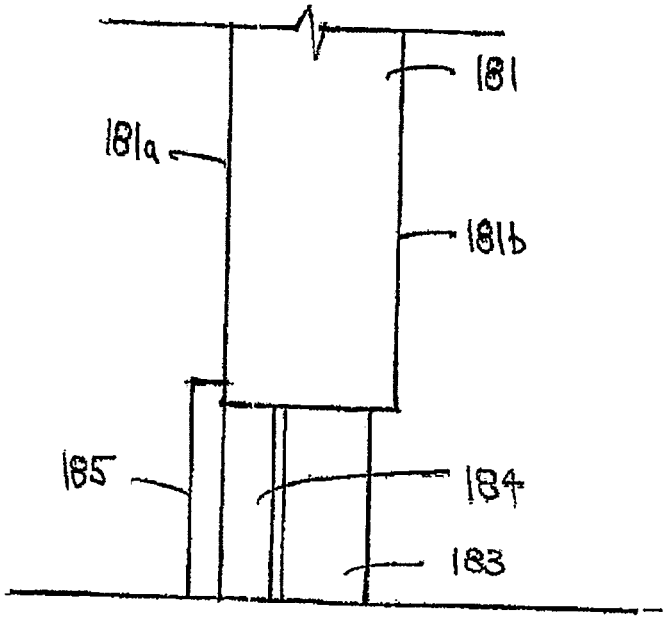

FIGS. 18*a* and 18*b* show a ceramic wall board 181 with ridges 182*a* and valleys 182*b*. This arrangement permits for a lightened yet strong board. The board also includes integral strengthening elements 183 running vertically within the material of the board. At the base of the board 181, the front face 181*a* does not extend downwards as far as the rear face 181*b* does. This provides a recessed bottom edge 184 on the front face. In FIG. 18*a*, the lower extent of the strengthening elements 183 can be seen. When used as a wall panel, the ceramic board 181 advantageously provides a recess 184 for running cables, pipes etc, which can be decoratively and practically covered by skirting 185. This arrangement obviates the need for exposed wires/pipes, or bulky and unsightly boxed conduit or boxed skirting currently used for hiding wires/pipes.

The inclusions of metal reinforcements and densities higher than existing boards make the boards according to the present invention stronger than known partitions, which enables builders to use boards for external use where security is an important issue.

If electrical or plumbing services need easy access near the floor, the board can be produced with recesses at the floor and channels along the board. This elicits additional space for cables, pipes, switches etc. The channels/recesses can then be covered by skirting.

Figure 19:
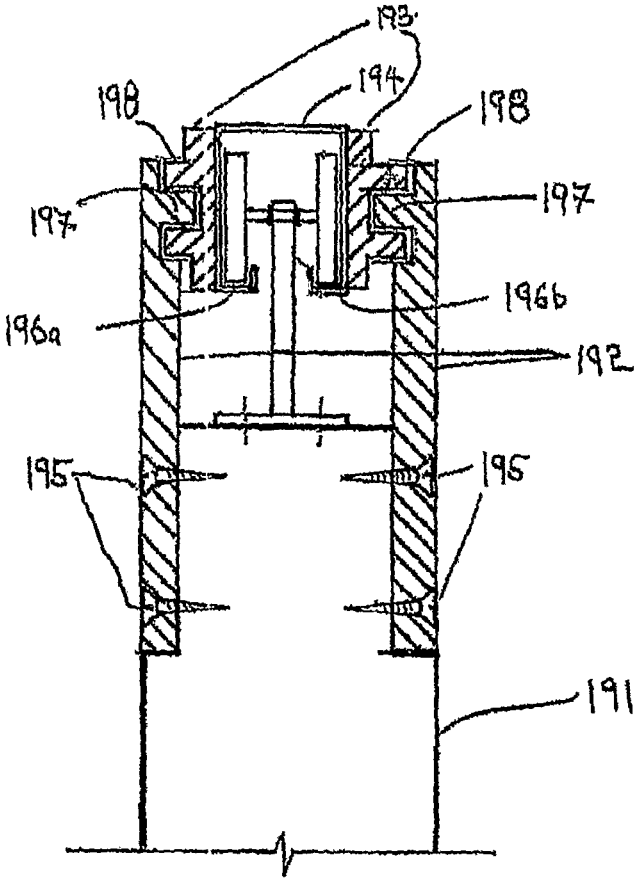
FIG. 19 shows an embodiment of the present invention in an arrangement utilising corrugated ceramic board in a sliding door panel system.

In the cases where acoustic performance is required in sliding door applications, the ceramic boards can be corrugated on one side thereof and arranged so that one corrugated board 192 affixes to each face at the top end of the board with the corrugations facing inwards, and further corrugated boards 193 attach to the sliding track/channel 194 with the corrugations facing outwards (FIG. 19). The door 191 is suspended from the track/channel 194 by a roller wheel arrangement 196*a*,196*b* which wheels engage with the channeUtrack. The corrugations 197 of the boards attached to the door slidably interengage with the corrugated boards attached to the track, though allowing relative movement thereof. Thus, when the door slides open or shut, an acoustic barrier is maintained due to the convoluted passage created by the interengaging corrugations.

Mounting brackets from which the door panel is suspended are arranged such that the mounting screws 195 are accessible from either side of the door, though screws extending from one side of the door through to the bracket on the opposite side of the door are envisaged.

Figure 20:
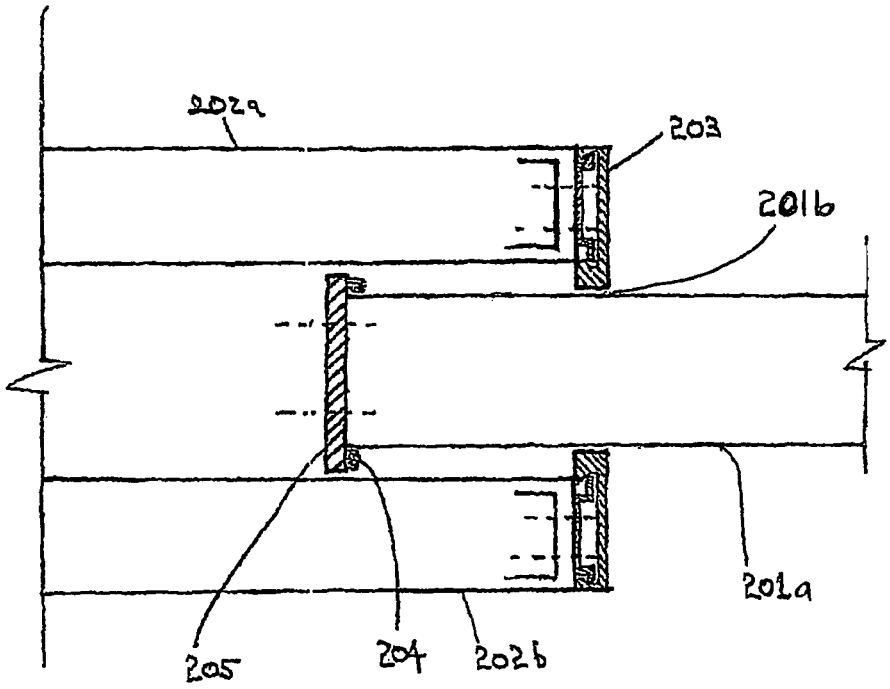
FIG. 20 shows a sliding panel/door arrangement of the present invention including an end stop and acoustic seal.

Add on stiffeners 203 can be attached to the door side edge of the board (both boards) so as to narrow the space between the boards, as shown in FIG. 20. The door end 204 (in wall cavity) can be fitted with a metal or plastic bar 205, or other sound reducing material such as felt or rubber, sponge brush, neoprene etc so that there is little or no through passage for sound to pass around the side edge of the door remaining in the cavity between the wall boards 201*a*, 201*b*. The bar 205 extends beyond the front and rear faces of the sliding door panel 201 so as to act as a stop against edge protectors 203 on the edges of the wall boards 202*a*, 202*b*.

Preferred thicknesses of the board or door panel are 6 mm to 50 mm, which advantageously can be lifted by one or two persons, as opposed to 100 mm thick concrete wall panels requiring lifting by a crane. Also, the boards/doors according to the present invention are at least water resistant or preferably waterproof, and so alleviate many of the problems associated with plasterboard type panels which can be affected by damp, moisture, condensation and rain.

For larger sizes of cabinet doors etc, a skeleton or frame work can be provided to add stability and rigidity to the door. Depending on the required fire rating, many arrangements are envisaged. The skeleton/framework will be of suitable thickness, width and material running around the perimeter of the board. These can be secured to the board using face fixings, such as countersunk screws. Adhesive mounting is also envisaged. The cabinet doors can be installed inset to the cabinet or overlayed.

To improve fire rating, a timber/ceramic frame 84 can be added to the inner walls of the cabinet where the cabinet hinges are located, and preferably along the internal perimeter (see FIGS. 8*a* and 8*b*).

Preferably a 10-30 mm frame will be used. This frame can provide a rebate or recess for the board to snugly fit into and create a stop for any fire. For cases where furnace pressure is high, intumescent seals can be provided along the cabinet door perimeter. The intumescent seals can be on the board edge or skeleton framework edge, depending on the various thickness selected. As intumescent seals expand when heated, the seals must be installed perpendicular to the board face so as to expand parallel to the door face to seal the gap.

For thermal insulation, insulation such as rockwool can be added to the skeleton/framework, and further coated with intumescent paint. Depending on requirements, filler material in the board can be ceramic, polymer based, polyurethane etc.

Should a wall panel comprising the board be required to mount heavy items like toilet bowls, sinks, kitchen sinks etc, and cannot allow for metal studs in the cavity due to gas and electrical equipment in the cavity, fibreglass or metal reinforcement can be introduced into the board during production of the board.

Furthermore, for more secure fixing, an even to facilitate welding, metal, plastic or similar reinforcement can be used. Preferably the reinforcement is in the form of a plate perforated with holes. This serves two purposes, due to the perforations the reinforcement plate is securely secured in the board through the perforations, and secondly, the perforations can serve as starter holes for screw fixings. Alternatively or in addition, a serrated or jagged edge to the plate provides good binding within or to the board.

A combination of fixing and skeleton reinforcements are used, pivot hinges can be used. In this case, perimeter reinforcement is used to ensure integrity of the board. This can comprise L section perforated metal or bent wire/expanded meta/plastic. At the pivot point and say optionally 100 mm either side thereof, a fixing reinforcement can be used to help spread the weight of the door. Fixing reinforcement can be of different material—for long spans of door, metal tends to expand and breakout of the ceramic if used as an integral skeleton. In this case, fibreglass, very thin gauge metal, wire netting or plastic can be used.

With the use of metal reinforcement skeletons in the present invention, the boards can be finished more neatly than known panels, without the need for unsightly cappings. Inclusion of internal reinforcement makes the boards of the present invention stronger and more resilient than known boards. This enables builders to use boards for external use where security is important and also for internal use where weight and strength are important issues.

In cases where acoustic sealing is important, eg sliding doors, the boards can be corrugated on one side and attached at the top to a sliding track which may also have corresponding corrugations. However, the resulting interengaging protrusions and valleys are optional and the top of the board or additional panels can be plain or have other features and may still provide a degree of acoustic sealing though not necessarily as effective as the corrugations (see FIG. 19). Mounting brackets for sliding door s partitions can be such that screw fastenings are accessible from the side edge and not face screwed to help facilitate servicing of the sliding door especially when in a recess or cavity wall application.

Add on stiffeners can be screwed to the door side edge of the board (preferably both boards of a double board door) so as to narrow the space/void between the boards. The door end (i.e. in cavity wall recess) can be fitted with a bar (metal, plastic etc) including a sound deadening material eg sponge, brush, felt as an acoustic seal so as to help prevent sound travelling around the inner end of the door within the cavity (see 204,205 FIG. 20).

Whilst the present invention has been described with reference to particular forms and embodiments, such forms and embodiments are exemplary of the present invention and are not to be taken to limit the generality, spirit and scope of the present invention.

The invention claimed is:

1. A ceramic board having a first face and a second face, wherein the first face and the second face are substantially parallel opposed, the first face having integral fins, webs, grooves, ridges, channels corrugations or an integral regular or irregular arrangement of indentations or protrusions extending over at least a portion of the first face;

where the material composition of the board includes at least one of calcium silicate, gypsum, cement or magnesium oxide and where the first face and the second face are spaced from one another by at least one removably mountable spacer, wherein the board includes a plurality of discrete internal strengthening elements, and wherein the removably mountable spacer forms a block having a rectangular cross section, and having a continuous inside fastening face and a continuous outside face which are perpendicular to the first face and second face of the board, the fastening face of the removably mountable spacer is positioned against an entire parallel mounting face of an edge-most fin, web, ridge, or protrusion of the first face of the board, and wherein the continuous outside face of the removably mountable spacer resides flush with or within the peripheral edge of the board; and wherein the plurality of discrete internal strengthening elements are at least partially exposed on at least one face of the board.

2. A ceramic board according to claim 1, wherein the removably mountable spacer is a support framework mounted to the first face.

3. A ceramic board according to claim 1, wherein the removably mountable spacer is fastened to the mounting face of the first face of the board by a fastener extending through the fastening face, the fastening face being a face in back to back arrangement with the mounting face.

4. A ceramic board according to claim 1, wherein the removably mountable spacer is inset from the periphery of at least one of the first and second faces which the removably mountable spacer spaces.

5. A ceramic board according to claim 1, wherein the board has an intumescent seal attached to a periphery thereof such that, when the board is used as a door hingedly connected to a frame, the intumescent seal acts as a seal between the door and the frame.

6. A ceramic board according to claim 1, wherein the material composition of the board includes gypsum, cement and a filler material.

7. A ceramic board according to claim 6, wherein the cement and gypsum are present in the proportions one part cement to ten parts gypsum.

8. A ceramic board according to claim 1, wherein the integral fins, webs, grooves, ridges, channels, corrugations or a regular or irregular arrangement of indentations or protrusions extending over at least a portion of the first face are connected to the second face.

9. A ceramic board according to claim 8, wherein the second face has integral fins, webs, grooves, ridges, channels, corrugations or a regular or irregular arrangement of indentations or protrusions extending over at least a portion of the second face, wherein the fins, webs, grooves, ridges, channels, corrugations or a regular or irregular arrangement of indentation or protrusions of the first face connect to the integral fins, webs, grooves, ridges, channels, corrugations or a regular or irregular arrangement of indentations or protrusions of the second face.

10. A ceramic board according to claim 8, wherein a connection is made by at least one of the group consisting of screws, nails, clamps and adhesives.

11. A ceramic board according to claim 1, wherein the plurality of discrete internal strengthening elements are at least partially exposed to atmosphere.

12. A ceramic board according to claim 1, wherein the plurality of discrete internal strengthening elements have a T, L or U shaped cross section.

13. A ceramic board according to claim 1, wherein the plurality of discrete internal strengthening elements are integral to the board.

14. A ceramic board according to claim 1, wherein the plurality of discrete internal strengthening members extend adjacent the periphery of the board.

15. A ceramic board according to claim 1, the board further including at least one threaded insert for later mounting a strengthening element.

16. A ceramic board according to claim 15, wherein the at least one threaded insert is integral to the board.

17. A ceramic board according to claim 1, wherein the board has an edge protector mounted thereto.

18. A ceramic board according to claim 17, wherein the edge protector is a removable clip fit edge strip or bumper.

19. A ceramic board according to claim 1, having a netting or mesh of fiberglass material, plastic or nylon attached to one of the first and second faces thereof.

20. A ceramic board according to claim 1 further comprising an external face, wherein the external face is substantially flat, and either smooth or lightly textured.

21. A ceramic board according to claim 1 further comprising an external face, wherein the external face includes an integral decorative pattern thereon.

22. A ceramic board according to claim 1, wherein the second face of the board having integral fins, webs, grooves, ridges, channels, corrugations or a regular or irregular arrangement of indentations or protrusions facing the fins, webs, grooves, ridges, channels, corrugations or a regular or irregular arrangement of indentations or protrusions of the first face, and wherein the fastening face of the removably mountable spacer is positioned against an entire parallel mounting face of the edge-most fin, web, ridge, or protrusion of the second face of the board.

23. A door assembly having a door panel including at least one ceramic board according to claim 1, and at least two cabinet hinges for hingedly mounting the door panel to operate as a cabinet door.

24. The door assembly according to claim 23, wherein the panel includes a supporting frame or blocks of material as provision for retaining the hinges.

25. The door assembly according to claim 24, wherein the provision for retaining the hinges are each about 75 mm by 50 mm by 15 mm for receiving hinge fastening means.

26. The door assembly according to claim 24, wherein the provision for retaining the hinges are adhesive or screw mounted to the door panel.

27. The door assembly according to claim 26, wherein the provision for retaining the hinges are front face fixed with respect to the ceramic board.

28. The door assembly according to claim 27, wherein the fastening means are screws with threads penetrating through the ceramic board from the front face to secure the respective hinge provision thereby sandwiching the ceramic board between screw heads and the hinge provisions.

29. The door assembly according to claim 28, wherein heads of fastening means exposed proximate the front face of the ceramic board are covered or disguised in the finished assembly.

30. The door assembly according to claim 29, wherein the heads of the fastening means are covered or disguised by a filler, such as putty, and sanded for painting so that the screws are not visible.

31. The door assembly according to claim 23, wherein the at least one ceramic board has a thickness of between about 3 and 30 mm to reduce weight.

32. The door assembly according to claim 23, further including a lock provision for mounting at least one lock.

33. The door assembly according to claim 32, wherein, for key cylinder locks, the lock provision thickness is between 15-25 mm so that the cylinder does not protrude too much out of a rear board face or get recessed too deep into the provision.

34. The door assembly according to claim 23, wherein each hinge and a lock provision, are coated with intumescent material.

35. The door assembly according to claim 23, further including insulating materials on a rear of the cabinet door for additional fire retardant insulation.

36. The door assembly according to claim 23, further including additional spaced stiffeners, the height and width of the stiffeners is such that it is adequate to attach stiles (vertical members) by mechanical and/or adhesive means.

37. The door assembly according to claim 36, wherein the stiffeners are closely spaced proximate at least one respective edge of the ceramic board to allow for cutting to suit site variations in required door dimensions and/or further spaced out in a middle portion of the board to reduce weight and production costs.

38. The door assembly according to claim 23, wherein, for single ceramic board cabinet doors having a smooth face facing outward of a cabinet when hingedly mounted, an additional provision internal of the door is made to attach cabinet hinges and locks, comprising reinforcements located in the board to take a fastening means.

39. The door assembly according to claim 23, wherein, for doors for large cabinets, such as at least 1 m wide x at least 2 m high, the door panel includes at least one stiffener located at one extreme edge of the board.

40. The door assembly according to claim 23, further including at least one restraint provided on the hinge side of the door to keep the door in place in the closed position in the event of hinge failure.

41. The door assembly according to claim 40, wherein the at least one restraint is a high temperature restraint provided separately.

42. The door assembly according to claim 40, wherein the at least one restraint is arranged to interengage with a portion of a cabinet or cupboard to which the door is mounted via the hinges.

43. The door assembly according to claim 42, wherein the at least one restraint includes at least one screw threaded member retained by the thread in either a portion of the door or a portion of the cabinet or cupboard, and the other of the door or cabinet/cupboard includes respective means to engage with the at least one member to provide the restraint in the event of hinge failure.

44. The door assembly according to claim 43, wherein the means to engage with the at least one member is provided by a channel arrangement with a respective member being received into a channel at least when the door is closed.

45. The ceramic board according to claim 1, wherein the plurality of discrete internal strengthening elements extend along a length of the board.

46. The ceramic board according to claim 1, wherein the plurality of discrete internal strengthening elements extend continuously along a substantial length of the board.

47. The ceramic board according to claim 1, wherein the plurality of discrete internal strengthening elements extend discontinuously along a substantial length of the board.

* * * * *